US011299360B2

(12) United States Patent
Katto

(10) Patent No.: US 11,299,360 B2
(45) Date of Patent: Apr. 12, 2022

(54) IMAGE FORMING APPARATUS FOR FORMING IMAGE ON SHEET

(71) Applicant: CANON KABUSHIKI KAISHA, Tokyo (JP)

(72) Inventor: Yohei Katto, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 400 days.

(21) Appl. No.: 16/200,953

(22) Filed: Nov. 27, 2018

(65) Prior Publication Data

US 2019/0161300 A1 May 30, 2019

(30) Foreign Application Priority Data

Nov. 28, 2017 (JP) ..... JP2017-228307

(51) Int. Cl.

| | |
|---|---|
| ***B65H 85/00*** | (2006.01) |
| ***B65H 9/00*** | (2006.01) |
| ***G03G 15/00*** | (2006.01) |
| ***B65H 7/06*** | (2006.01) |
| ***G03G 15/23*** | (2006.01) |

(52) U.S. Cl.

CPC ..... *B65H 9/002* (2013.01); *B65H 7/06* (2013.01); *B65H 9/006* (2013.01); *B65H 85/00* (2013.01); *G03G 15/231* (2013.01); *G03G 15/234* (2013.01); *G03G 15/6529* (2013.01); *B65H 2511/51* (2013.01); *B65H 2513/10* (2013.01); *B65H 2513/50* (2013.01); *G03G 15/6561* (2013.01); *G03G 2221/1657* (2013.01)

(58) Field of Classification Search

CPC ..... B65H 9/002; B65H 7/06; B65H 9/006; B65H 85/00; G03G 15/231; G03G 15/234

See application file for complete search history.

(56) References Cited

U.S. PATENT DOCUMENTS

| | | | | |
|---|---|---|---|---|
| 6,577,844 | B2 * | 6/2003 | Kamei | G03G 15/234 399/301 |
| 8,577,234 | B2 | 11/2013 | Kato | |
| 2019/0072893 | A1 * | 3/2019 | Deno | B65H 29/60 |

FOREIGN PATENT DOCUMENTS

| | | | |
|---|---|---|---|
| JP | 2001-166663 | A | 6/2001 |
| JP | 2001-247233 | A | 9/2001 |
| JP | 2007-108587 | A | 4/2007 |

(Continued)

OTHER PUBLICATIONS

Office Action dated Sep. 24, 2021, in Japanese Patent Application No. 2017-228307.

*Primary Examiner* — Thomas A Morrison
(74) *Attorney, Agent, or Firm* — Venable LLP

(57) ABSTRACT

In an image forming apparatus that can form images on both surfaces of a sheet, a first roller conveys a sheet conveyed from a reversal roller and a first motor drives the reversal and first rollers. A one-way clutch restricts transfer of a driving force from the first motor to the first roller while the reversal roller is conveying a sheet in a first direction, and permits transfer of a driving force from the first motor to the first roller while the reversal roller is conveying a sheet in a second direction. Second and third rollers are provided on a downstream side of the first roller. A second motor drives the second and third rollers. A controller drives both of the first and second motors when resuming conveyance of a sheet conveyed on a duplex conveyance path after causing the sheet to await abutment with the second roller.

10 Claims, 16 Drawing Sheets

(56) References Cited

FOREIGN PATENT DOCUMENTS

| | | | |
|---|---|---|---|
| JP | 2010-102173 | A | 5/2010 |
| JP | 2013-010601 | A | 1/2013 |
| JP | 5720438 | B2 | 5/2015 |

* cited by examiner

IMAGE FORMING APPARATUS FOR FORMING IMAGE ON SHEET

BACKGROUND OF THE INVENTION

Field of the Invention

The present invention relates to an image forming apparatus for forming an image on a sheet.

Description of the Related Art

An image forming apparatus can form images on both surfaces of a sheet. A reversal roller provided near a discharge port performs a switchback for a sheet on which an image has been formed on a first surface. The sheet that has been subject to a switchback is circulated inside the image forming apparatus, an image is formed on a second surface by an image forming unit, and the sheet is discharged from the discharge port. According to Japanese Patent No. 5720438, three rollers and three motors for conveying three sheets on which images have been formed on first surfaces thereof by a conveyance path for duplex printing are provided.

In Japanese Patent No. 5720438, a manufacturing cost increases because it is necessary to have the same number of motors as the number of sheets that can concurrently wait in a duplex printing conveyance path.

SUMMARY OF THE INVENTION

The present invention provides an image forming apparatus which may comprise the following elements. A container unit is configured to contain a sheet. An image forming unit is configured to form an image on the sheet. A discharge unit is configured to discharge the sheet onto which the image was formed. A main conveyance path, on which a sheet is conveyed, is provided from the container unit to the discharge unit via the image forming unit. An auxiliary conveyance path divides from the main conveyance path, wherein a sheet to which an image has been formed on a first surface thereof is conveyed on the auxiliary conveyance path in order to form an image on a second surface of the sheet. A reversing and conveying path is connected to the auxiliary conveyance path, wherein the sheet that has been conveyed from the auxiliary conveyance path is conveyed on the reversing and conveying path in order to reverse a conveyance direction of the sheet. A duplex conveyance path is joined to the main conveyance path, wherein the sheet fed from the reversing and conveying path is conveyed on the duplex conveyance path in order to form the image on the second surface of the sheet. A registration roller is provided in the main conveyance path, on a downstream side of a joining portion of the main conveyance path and the duplex conveyance path and on an upstream side of the image forming unit with respect to the conveyance direction of the sheet. A reversal roller is configured to pull the sheet to which the image is formed on the first surface into the reversing and conveying path by conveying the sheet in a first direction, and feed the sheet into the duplex conveyance path by conveying the sheet in a second direction opposite to the first direction. A first roller is provided in the duplex conveyance path on a downstream side of a connection point between the reversing and conveying path and the duplex conveyance path, and configured to convey a sheet conveyed from the reversal roller. A first motor is configured to drive the reversal roller and the first roller. A one-way clutch is configured to restrict transfer of a driving force from the first motor to the first roller while the reversal roller is conveying a sheet in the first direction, and permit transfer of a driving force from the first motor to the first roller while the reversal roller is conveying a sheet in the second direction. A second roller is provided in the duplex conveyance path and on a downstream side of the first roller in the conveyance direction of the sheet, and configured to convey the sheet. A third roller is provided in the duplex conveyance path and on a downstream side of the second roller in the conveyance direction of the sheet, and configured to convey the sheet. A second motor is configured to drive the second roller and the third roller. A controller is configured to control the first motor and the second motor so as to drive both of the first motor and the second motor when resuming conveyance of a sheet conveyed on the duplex conveyance path after causing the sheet to wait abutting the second roller.

Further features of the present invention will become apparent from the following description of exemplary embodiments (with reference to the attached drawings).

DESCRIPTION OF THE EMBODIMENTS

[Image forming apparatus]

Figure 1:
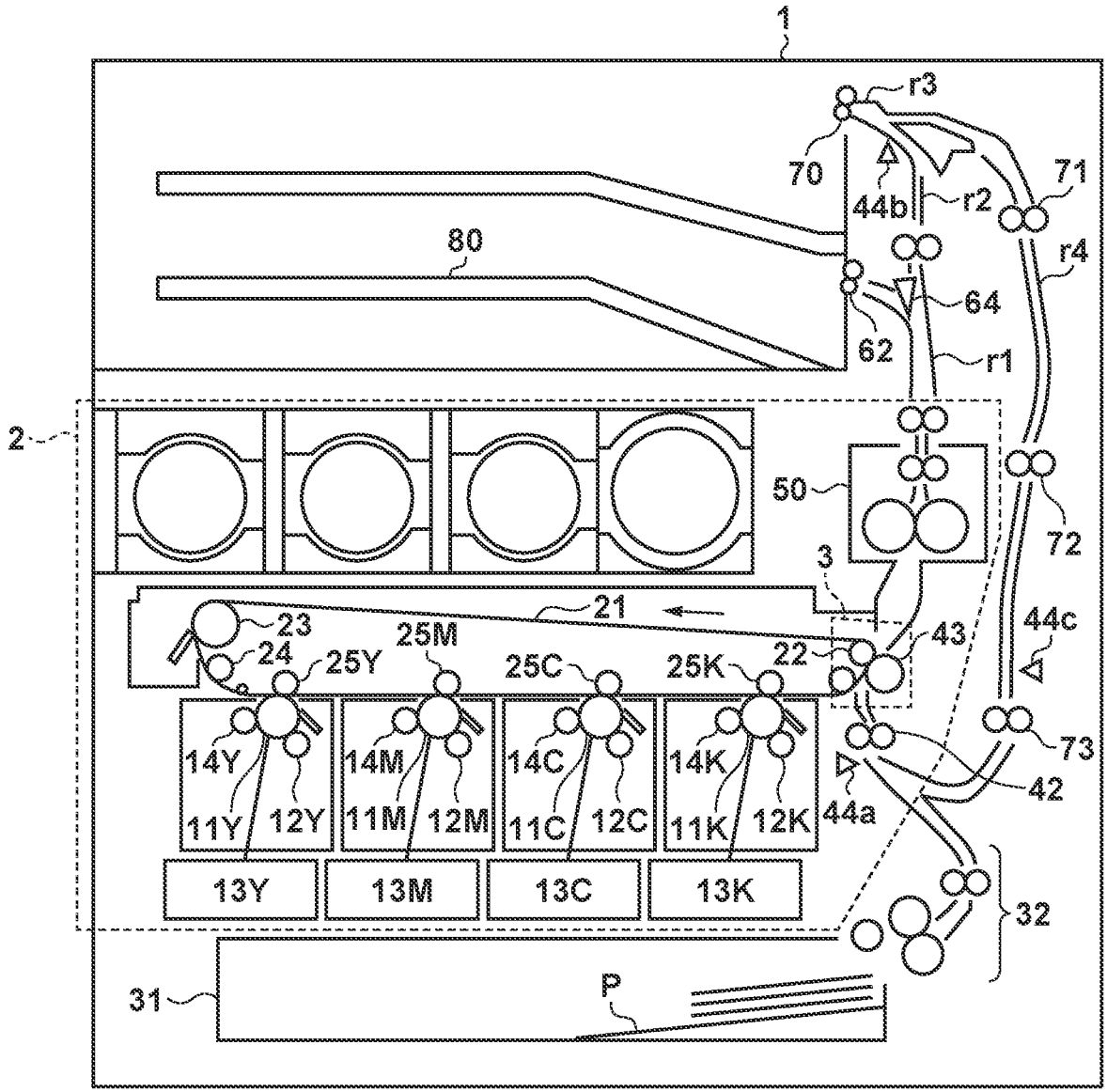
FIG. 1 is a cross-sectional view that illustrates an internal configuration of an image forming apparatus.

FIG. 1 illustrates a configuration of an image forming apparatus 1. Letters Y, M, C, and K at the end of reference numerals are each toner colors, and indicate, yellow, magenta, cyan, and black. In the case where there is no necessity to distinguish colors, reference numerals that exclude letters at the end thereof are used. An image forming unit 2 uses toner to form a toner image. A charging apparatus 12 charges a surface of a photosensitive body 11 which is an image carrier. An exposure device 13 exposes the photosensitive body 11 to form an electrostatic latent image on the photosensitive body 11. A developing apparatus 14 develops an electrostatic latent image on the photosensitive body 11 by toner to form a toner image on the photosensitive body 11. A primary transfer apparatus 25 transfers a toner image on the photosensitive body 11 to an intermediate transfer belt 21. By overlappingly transferring toner images for each of Y, M, C, and K onto the intermediate transfer belt 21, a full-color toner image is formed on the intermediate transfer belt 21. The intermediate transfer belt 21 is stretched over a driving roller 23, a tension roller 24, and an internal roller 22, and rotates in the direction of the arrow symbol to convey a toner image to a secondary transfer unit 3. The secondary transfer unit 3 is formed by the intermediate transfer belt 21, the internal roller 22, and an external roller 43. Because the secondary transfer unit 3 forms a toner image on a sheet P, it may be referred to as an image forming unit.

A container 31 contains a plurality of sheets P. A feed mechanism 32 includes a feed roller, a separation roller pair, and the like, feeds a sheet contained in the container 31 into a conveyance path r1, and conveys the sheet to registration rollers 42. At this point the sheet P abuts the registration rollers 42 which are stopped. Consequently, a loop (a bend) is formed at a leading end portion of the sheet P, and skewing of the sheet P is corrected. In this way, the loop is formed by reducing the conveyance speed of a leading end region of the sheet P so that it is less than the conveyance speed of a trailing end region. The registration rollers 42 convey the sheet P so that a timing at which the toner image on the intermediate transfer belt 21 reaches the secondary transfer unit 3 matches a timing when the sheet P reaches the secondary transfer unit 3. The external roller 43 and the intermediate transfer belt 21 convey the sheet P onto which the toner image has been transferred to a fixing apparatus 50. The fixing apparatus 50 pressurizes and heats sheets P to fix the toner image to sheets P.

In a case of forming an image on only one surface (a first surface) of the sheet P, a flapper 64 guides the sheet P to discharge rollers 62. The discharge rollers 62 discharge the sheet P to a discharge tray 80. The conveyance path r1 is a conveyance path from the container 31 and reaches the discharge rollers 62 via the image forming unit 2, and may be referred to as a main conveyance path. In a case of also forming an image on the second surface of the sheet P, the flapper 64 guides the sheet P, onto which an image has been formed on the first surface thereof, to reversal rollers 70 via a conveyance path r2. The conveyance path r2 is also referred to as an auxiliary conveyance path. In a conveyance path r3, the reversal rollers 70 convey the sheet P in a first direction by nipping the leading end of the sheet P. The conveyance path r3 is also referred to as a reversing and conveying path. When the trailing end of the sheet P is nipped by the reversal rollers 70, the reversal rollers 70 reverse their rotational directions and convey the sheet P in a second direction. In other words, the reversal rollers 70 feed the sheet P from the conveyance path r3 to a conveyance path r4. The conveyance path r4 is also referred to as a duplex conveyance path. A sheet sensor 44*b* may be provided at a portion for connecting the conveyance path r3 and the conveyance path r4. The sheet sensor 44*b* is used to detect that the sheet P has been sufficiently pulled inside the conveyance path r3 to that sheets P can be fed into the conveyance path r4.

The conveyance path r4 is a conveyance path on which the sheet P, whose front and back have been reversed by the reversal rollers 70, is conveyed for printing onto a second surface thereof for duplex printing. First rollers 71 are provided in the conveyance path r4, and these convey the sheet P that has been handed over by the reversal rollers 70 downstream. Second rollers 72 provided on a downstream side from the first rollers 71 in the conveyance direction of the sheet P convey the sheet P which has been handed over from the first rollers 71 downstream. Third rollers 73 provided on a downstream side from the second rollers 72 in the conveyance direction of the sheet P convey the sheet P which has been handed over from the second rollers 72 downstream, and transfer it to the registration rollers 42. The registration rollers 42 convey the sheet P, which has been handed over from the third rollers 73, to the secondary transfer unit 3 again. The secondary transfer unit 3 transfers a toner image to the second surface of the sheet P. The fixing apparatus 50 fixes the toner image to the second surface. The flapper 64 guides the sheet P to the discharge tray 80.

A sheet sensor 44*a* is provided in the conveyance path r1 on an upstream side from the registration rollers 42. The sheet sensor 44*a* is a sensor (a registration sensor) for detecting a sheet P feed from the feed mechanism 32 or the conveyance path r4. A sheet sensor 44*c* is provided in the conveyance path r4 between the second rollers 72 and the third rollers 73, and is a sensor (a duplex sensor) for detecting a sheet P that has passed through the second rollers 72.

[Controller]

Figure 2:
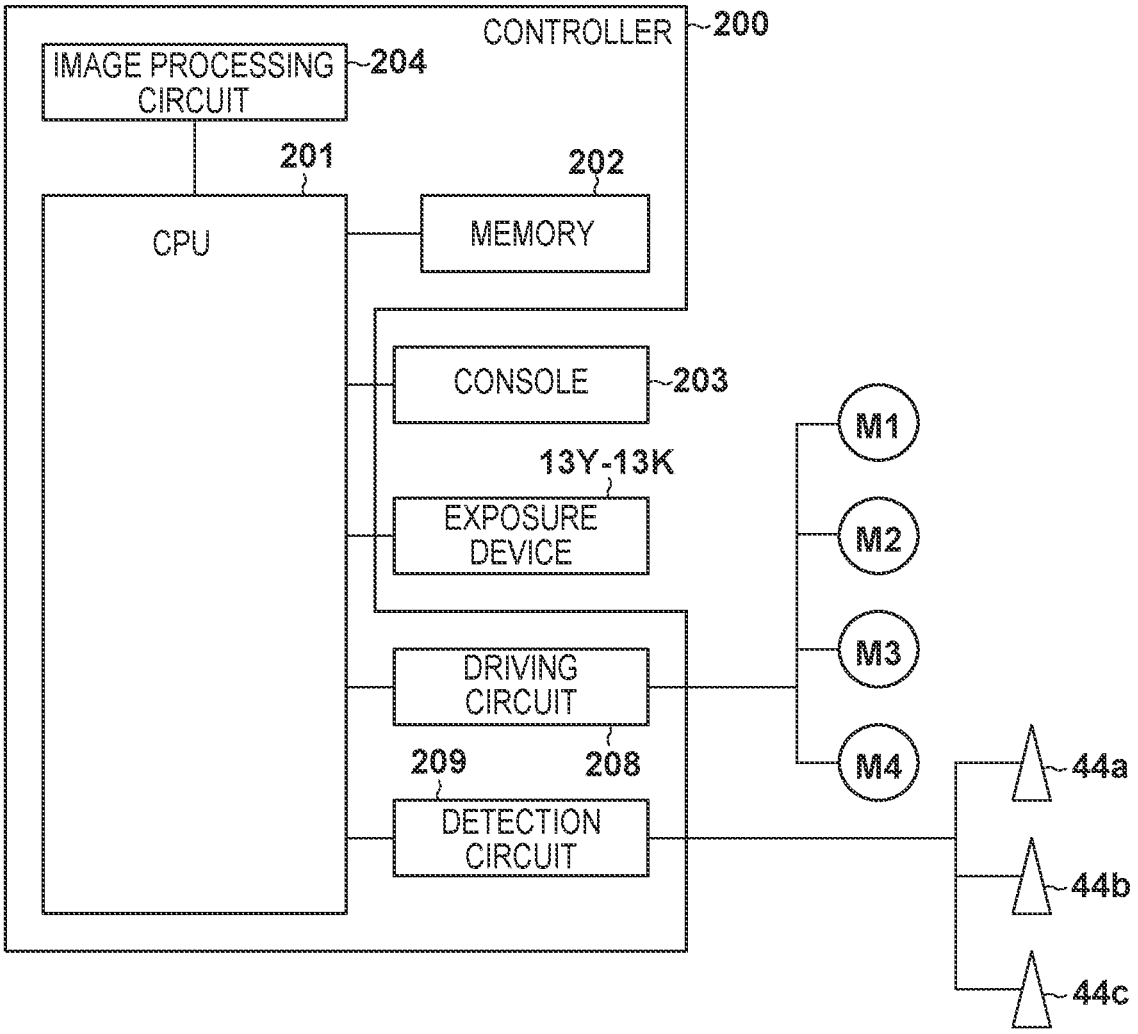
FIG. 2 is a block diagram that illustrates a controller.

FIG. 2 illustrates a controller 200 for controlling the image forming apparatus 1. A CPU 201 executes a control program stored in a ROM of a memory 202 to control the image forming apparatus 1. The memory 202 includes a RAM and a ROM, and stores the control program, and various data. CPU is an abbreviation for Central Processing Unit. The RAM is an abbreviation for Random Access Memory. ROM is an abbreviation for Read-Only Memory. A console 203 provides a user interface. An operator operates an input apparatus of the console 203 to set a print job. The print job includes setting information for simplex printing or duplex printing, and information indicating a number of sheets P. The controller 200 may receive a print job from a host computer or the like. An image processing circuit 204 may rasterize image data received from a host computer to generate an image signal. The CPU 201 executes conveyance control for the sheet P and image forming control in accordance with a print job. For example, the CPU 201 controls the exposure device 13 based on an image signal generated in the image processing circuit 204. When output preparation for an image signal is ready, the image processing circuit 204 may output a permission signal to the CPU 201. A driving circuit 208 drives motors M1 to M4 in accordance with an instruction from the CPU 201. The motor M1 is a driving source for driving the reversal rollers 70 and the first rollers 71. The motor M2 is a driving source for driving the second rollers 72 and the third rollers 73. The motor M3 is a motor for driving the feed mechanism 32. The motor M4 is a motor for driving the registration rollers 42. Only some motors related to the image forming apparatus 1 are exemplified here. A detection circuit 209 is a circuit for converting detection signals outputted by the sheet sensors 44*a*, 44*b*, and 44*c* to signals of levels that can be processed by the CPU 201.

[Number of Motors]

Figure 3A:
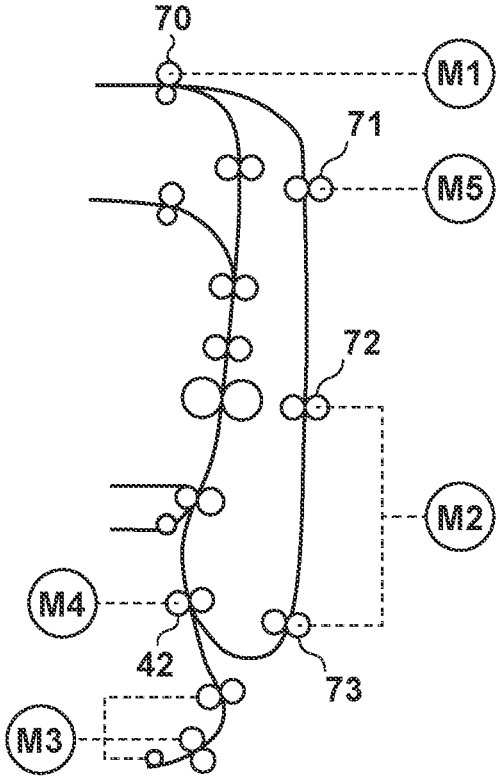
FIGS. 3A and 3B are views that illustrate a relationship between conveyance rollers and driving sources.
Figure 3B:
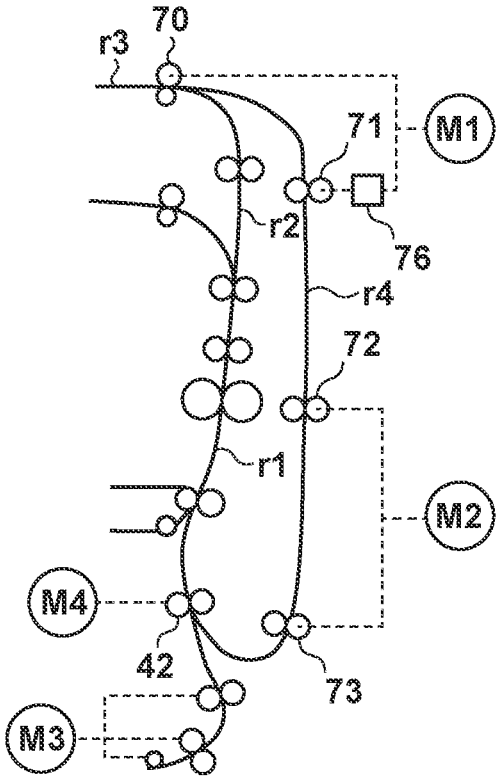

FIG. 3A illustrates a relationship between a driving source and a roller in a comparative example. FIG. 3B illustrates a relationship between a driving source and a roller in the embodiment. To simplify the description some mechanisms and reference numerals are omitted. As illustrated by FIG. 3A, the reversal rollers 70 are driven by the motor M1, and the first rollers 71 are driven by a motor M5. Furthermore, the second rollers 72 and the third rollers 73 are driven by the motor M2, and the registration rollers 42 are driven by the motor M4. However, in the embodiment, the motor M5 is removed, and instead the motor M1 also drives the first rollers 71. A one-way clutch 76 is provided as transfer mechanism for transferring a driving force from the motor M1 to the first rollers 71. The one-way clutch 76 blocks the driving force when the motor M1 is rotating in a forward direction, and transfers the driving force when the motor M1 is rotating in a backward direction. In other words, the one-way clutch 76 conveys a driving force for conveying the sheet P in the conveyance direction of the sheet P in the conveyance path r4 to the first rollers 71. The one-way clutch 76 does not convey a driving force for conveying the sheet P in an opposite direction (a first direction) of the conveyance direction of the sheet P in the conveyance path r4 (a second direction) to the first rollers 71.

[Image Formation Interval]

The image forming apparatus 1, in a normal image forming operation, forms images on a plurality of sheets P while conveying the plurality of sheets P at a predetermined interval (hereinafter referred to as an image formation interval). The image formation interval decides the number of images formed per unit time, in other words the productivity. Here, for various reasons, the image formation interval may become longer, and the productivity may decrease. For example, when the temperature of the fixing apparatus 50 becomes too high, the CPU 201 lengthens the image formation interval in order to cool the fixing apparatus 50. When processing time in the image processing circuit 204 with respect to image data transferred from a host computer becomes too long, the CPU 201 lengthens the image formation interval. Here, there are cases where the CPU 201 must determine whether or not there is a need to delay image formation immediately prior to the start of exposure by the exposure device 13. In addition, it is required that a time-lag from when permission to write an image is made until exposure starts be as small as possible. This is because there is a desire to have image forming time for the sheet be a minimum. Accordingly, when permission to write an image is not made, the CPU 201 causes a sheet P to wait at the registration rollers 42. When image write permission is given, the CPU 201 drives the registration rollers 42 again, and feeds the sheet P to the secondary transfer unit 3. Consequently, the waiting time until image formation becomes small. Whether or not to write an image can be managed in accordance with a flag or the like. For example, the CPU 201 sets a flag to 0 (no permission) if the temperature of the fixing apparatus 50 is outside of an allowable range. The CPU 201 sets the flag to 0 (no permission) if the image processing circuit 204 cannot output an image signal. If the image processing circuit 204 can output an image signal and the temperature of the fixing apparatus 50 is inside the allowable range, the CPU 201 sets the flag to 1 (permission). Whether or not to write an image may be determined based on complex conditions.

[Image formation order]

Figure 4A:
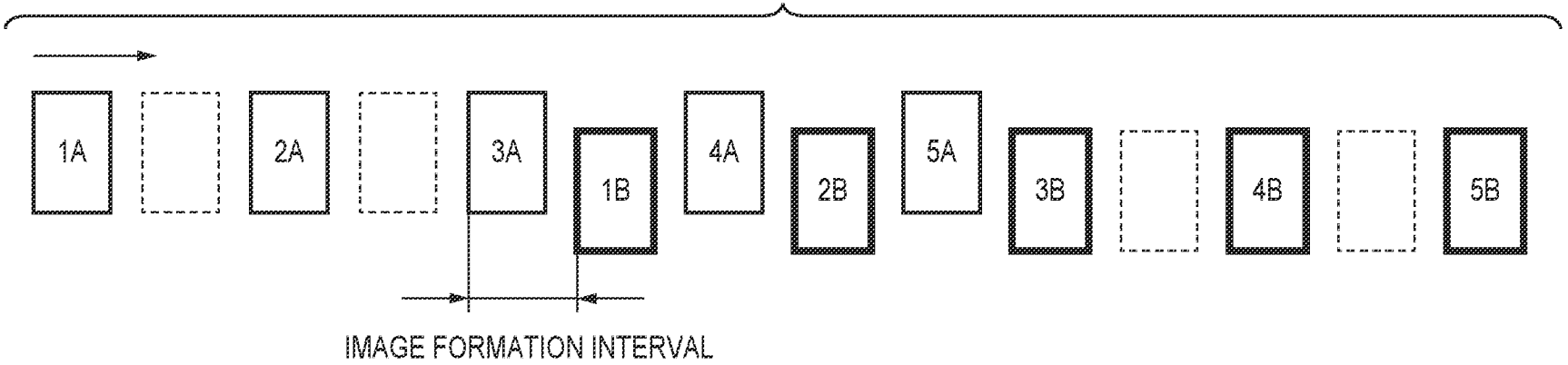
FIGS. 4A and 4B are views for describing image formation intervals.
Figure 4B:
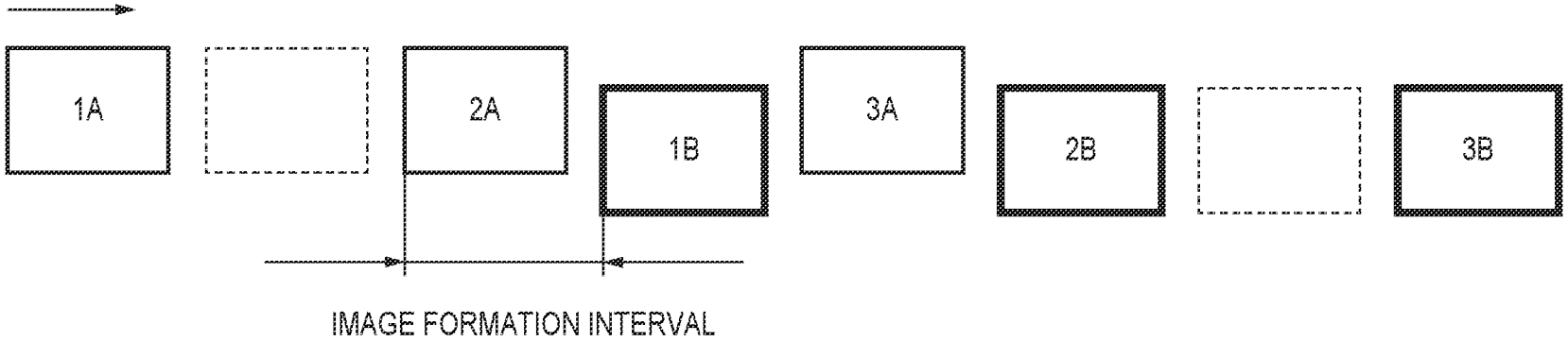

FIG. 4A illustrates an image formation order for sheets P of a small size (A4 or letter). FIG. 4B illustrates an image formation order for sheets P of a large size (A3 or ledger). Numerals indicate numbers (a feeding order) of the sheets P. The letter A indicates that the first surface (a front surface) of a sheet P is a surface for forming an image. The letter B indicates that the second surface (a back surface) of a sheet P is a surface for forming an image. As illustrated by FIG. 4A and FIG. 4B, in duplex printing, there is a period where image formation on a first surface and image formation on a second surface are alternately performed. When image formation on a first surface and image formation on a second surface are alternately performed, an interval between two sheets is the image formation interval. In other words, the image formation interval is the sum of a sheet length and a sheet interval. The image formation interval is normally a fixed interval. In the present embodiment, the small size is a size for which it is possible to cause three sheets P to wait in the conveyance path r3 and the conveyance path r4. The large size is a size for which it is not possible to cause three sheets P to wait in the conveyance path r3 and the conveyance path r4. For example, for the former, the sheet length of an A4 size is 210 [mm] and the sheet length of a letter size is 215.9 [mm]. For the latter, the sheet length of an A3 size is 420 [mm] and the sheet length of a ledger size is 431.8 [mm].

FIG. 4A illustrates an image formation order for a case where duplex printing is performed on five sheets of a small size. As illustrated by FIG. 4A, the image forming apparatus 1 forms images of three sheets 1A, 2A, and 3A (first surfaces). Subsequently, the image forming apparatus 1 forms images on each of the first sheet 1B (a second surface), the fourth sheet 4A (a first surface), and the second sheet 2B (a second surface). In other words, images are alternately formed on the first surface of one sheet and the second surface of another sheet. After forming an image on the third sheet 3B (a second surface), the image forming apparatus 1 forms images on each of the fourth and fifth sheets 4B and 5B (second surfaces).

Here, in the embodiment it is assumed that the sheet 1B waits (stops) at the registration rollers 42 with no permission given to write an image to be formed on the first sheet 1B (a second surface). In other words, in FIG. 4A, an image formation interval between the sheet 3A and the sheet 1B becomes longer than normal. By the wait time for the sheet 1B lengthening, the sheet 2B and the sheet 3B, which follow in the conveyance path r4, must wait. This is to suppress the sheet 2B colliding with the sheet 1B.

Figure 5B:
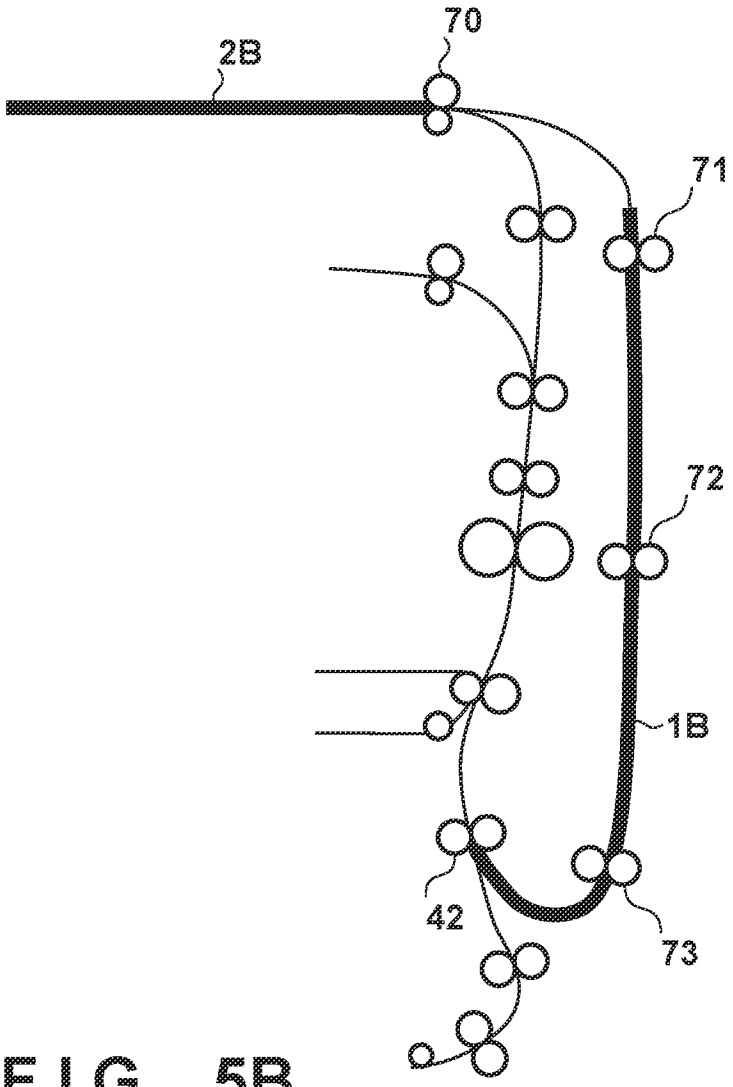
FIGS. 5A and 5B are views for describing sheet waiting.
Figure 5A:
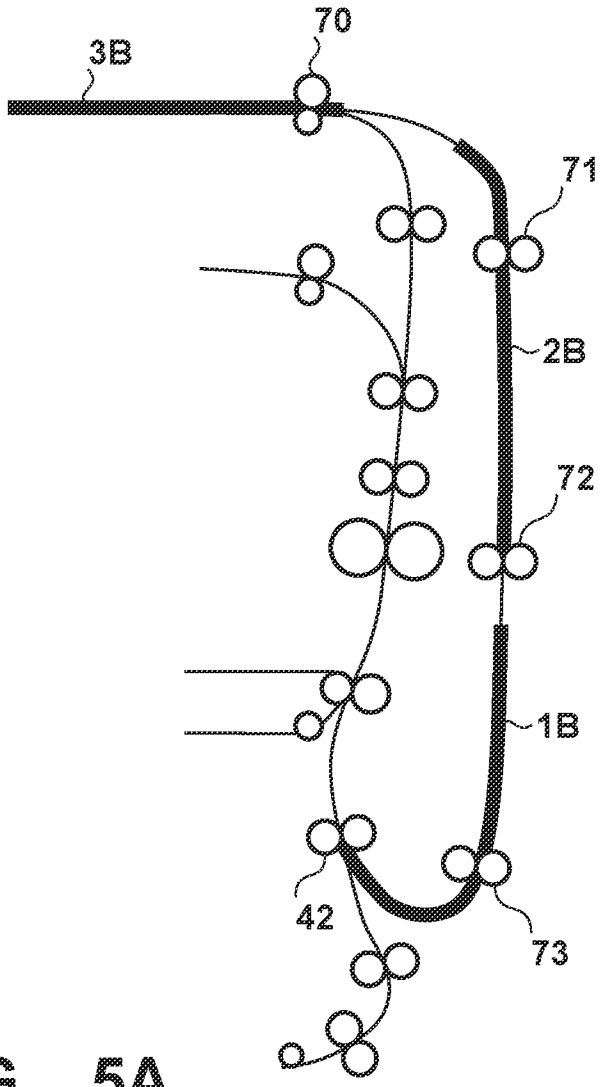

FIG. 5A illustrates a state where each of the sheet 1B, the sheet 2B, and the sheet 3B are waiting. The sheet 2B is waiting in the conveyance path r4. The sheet 3B is waiting in the conveyance path r3. Permission to write an image to be formed on a sheet is issued when the sheet is positioned just before the registration rollers 42. Accordingly, the CPU 201 stops the sheet 1B, then stops the sheet 2B, and subsequently stops the sheet 3B. In other words, the three sheets must be independently controlled. To realize this, the three motors M1, M2, and M5 are necessary in the comparative example illustrated in FIG. 3A. In contrast to this, in the present embodiment, as illustrated by FIG. 3B the motor M5 is unnecessary, and realization by the two motors M1 and M2 is possible. As illustrated by FIG. 4B and FIG. 5B, two large size sheets can wait in the conveyance path r3 and the conveyance path r4. To independently control two sheets it is sufficient if there are two motors. Accordingly, description is given in detail below regarding a method of conveying three small size sheets by the two motors M1 and M2.

[Wait Operations for Three Sheets]

Figure 6:
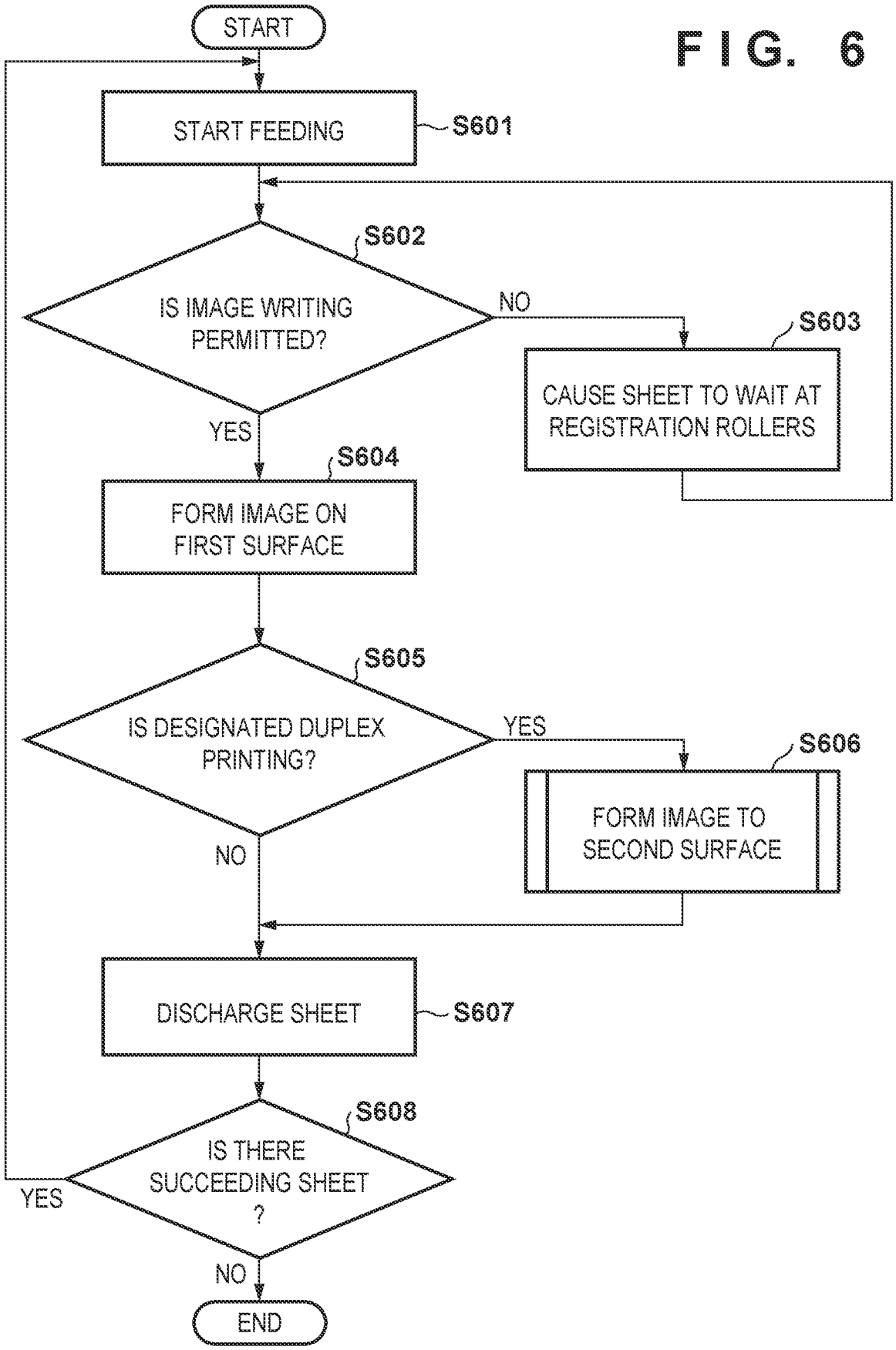
FIG. 6 is a flowchart that illustrates a conveyance process.
Figure 7:
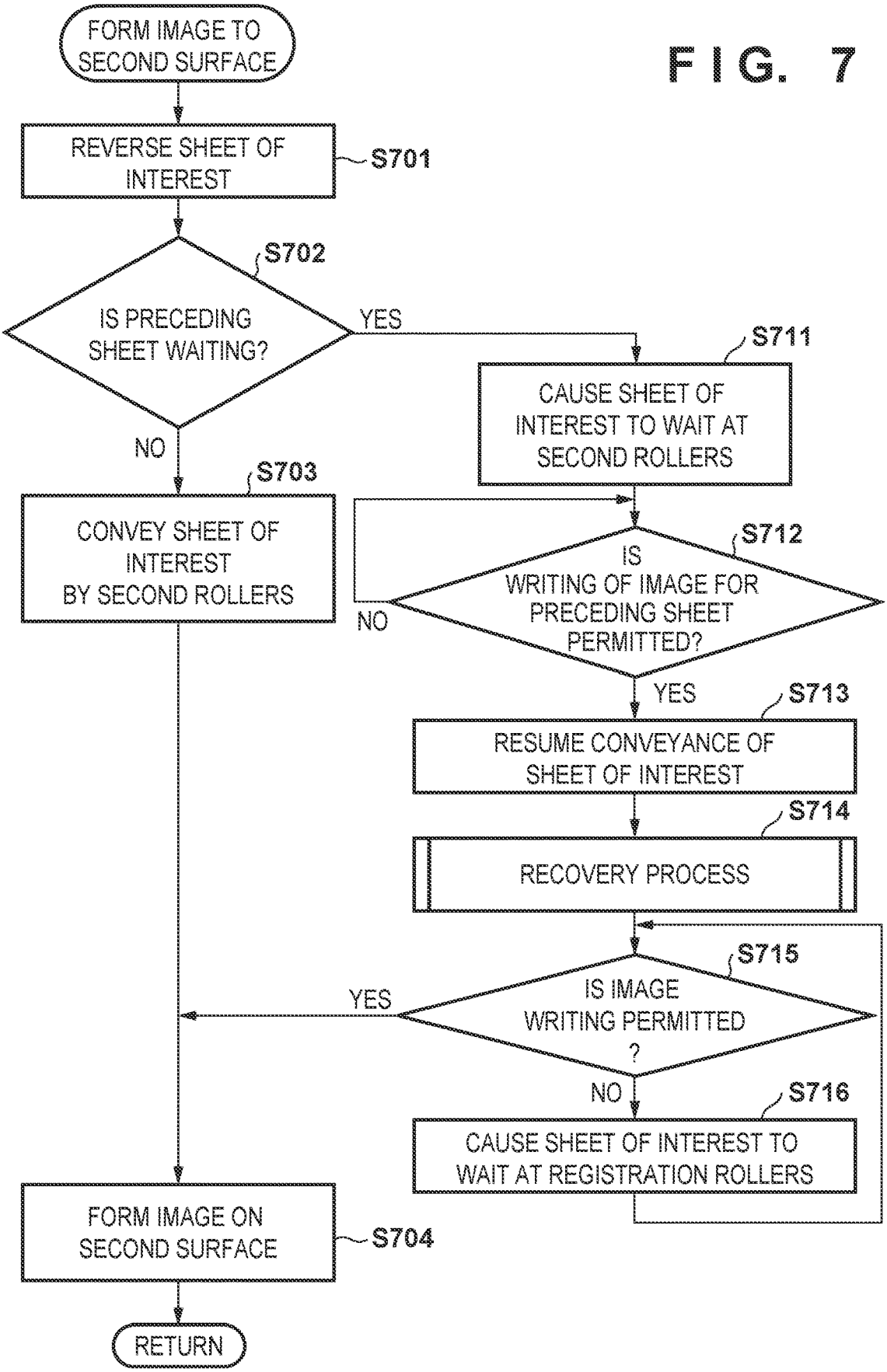
FIG. 7 is a flowchart that illustrates image formation with respect to a second surface.
Figure 8:
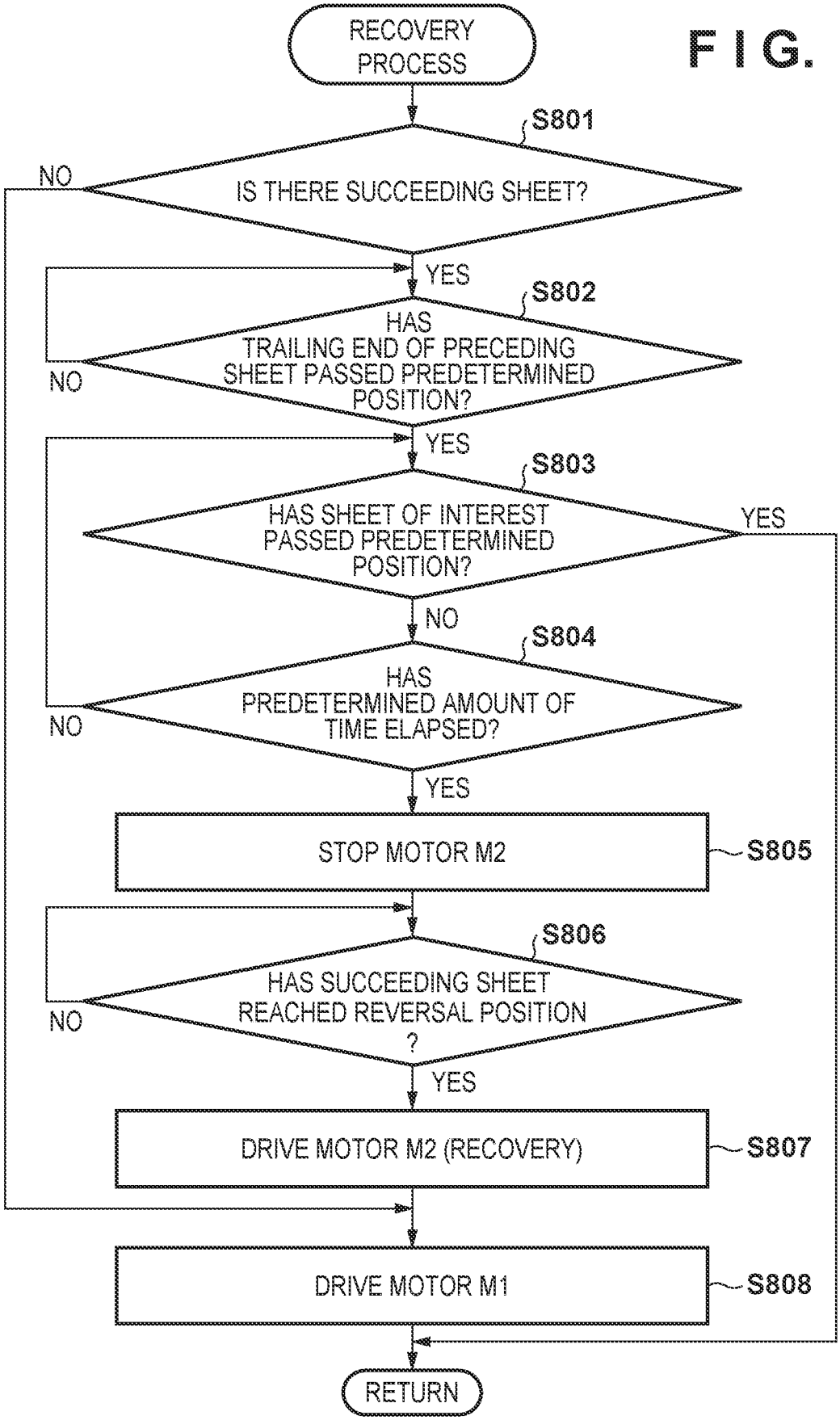
FIG. 8 is a flowchart that illustrates a recovery process.
Figure 9B:
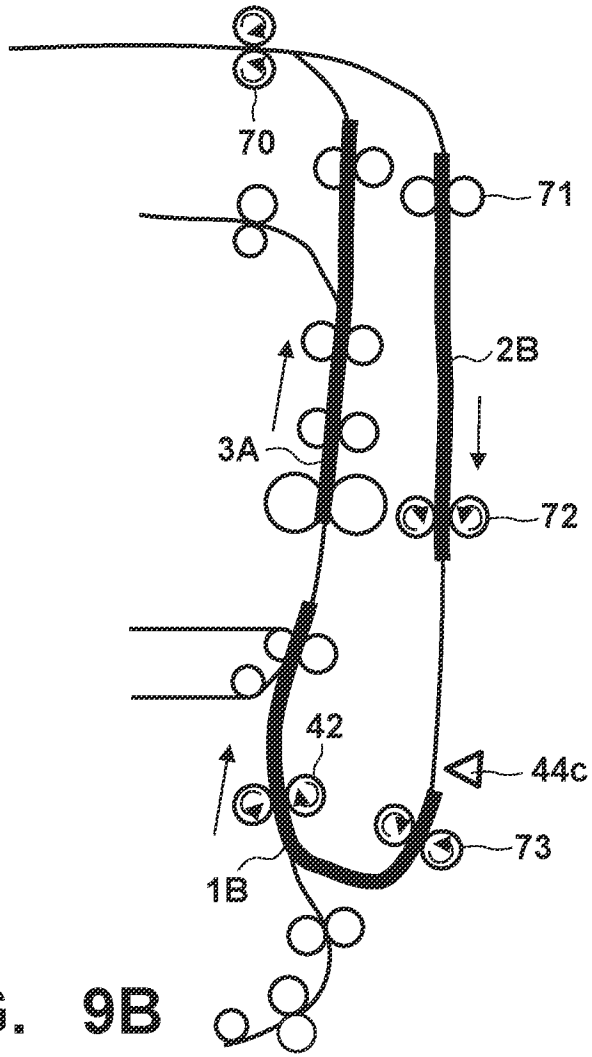
FIGS. 9A and 9B are views for describing positions of sheets and rotation and stoppage of rollers.
Figure 9A:
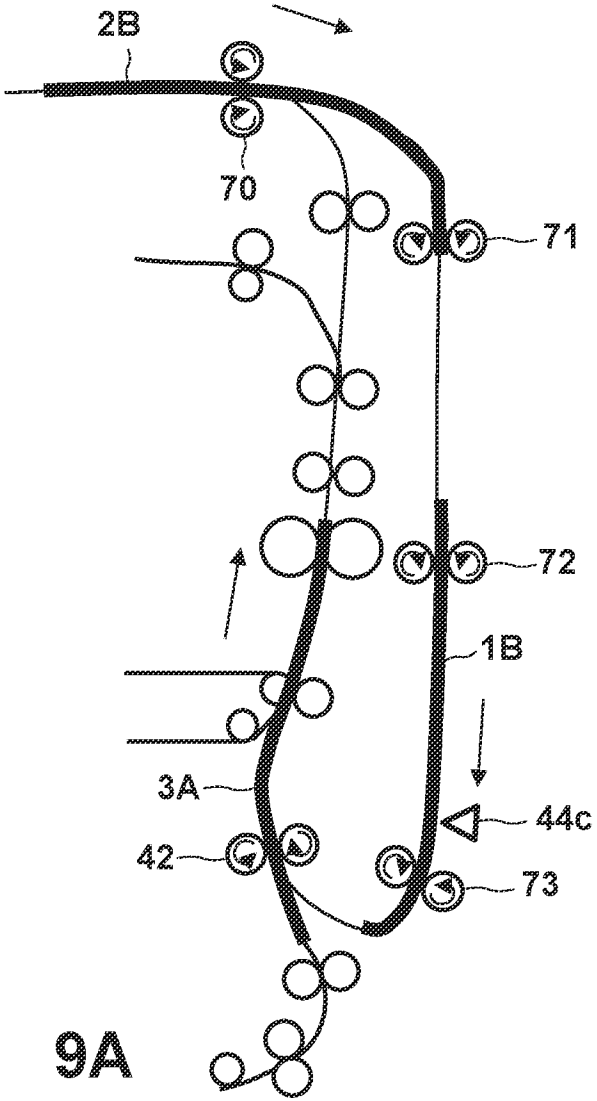
Figure 10C:
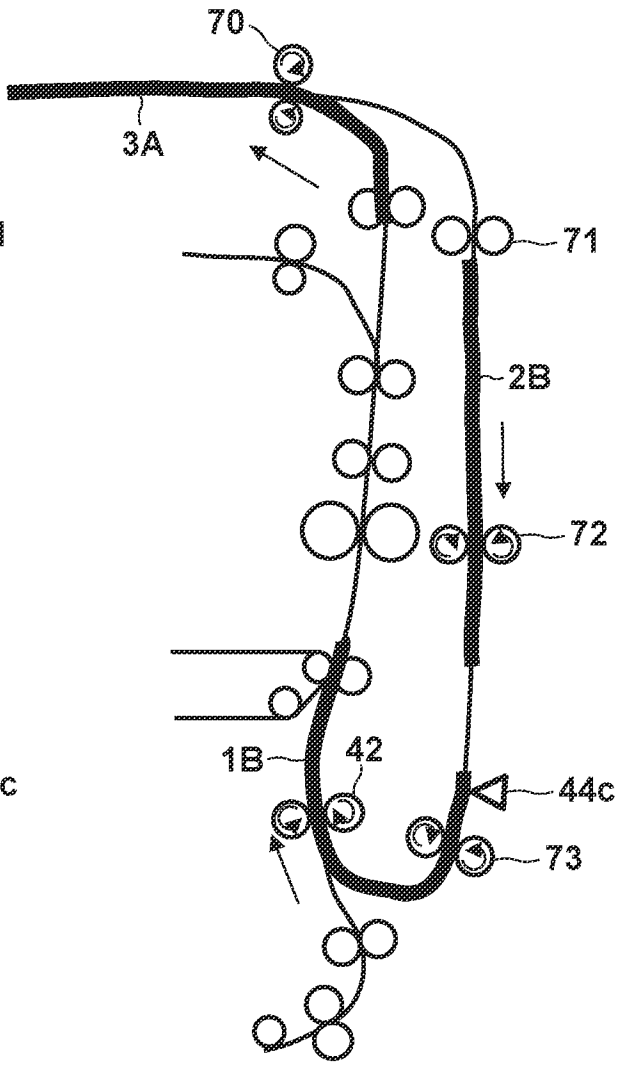
FIGS. 10A to 10C are views for describing positions of sheets and rotation and stoppage of rollers.
Figure 10B:
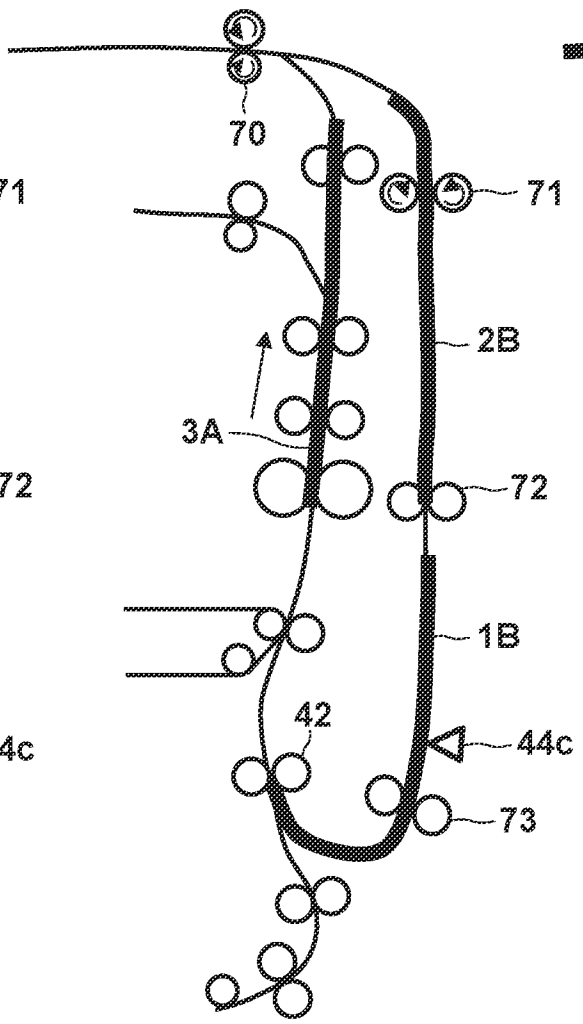
Figure 10A:
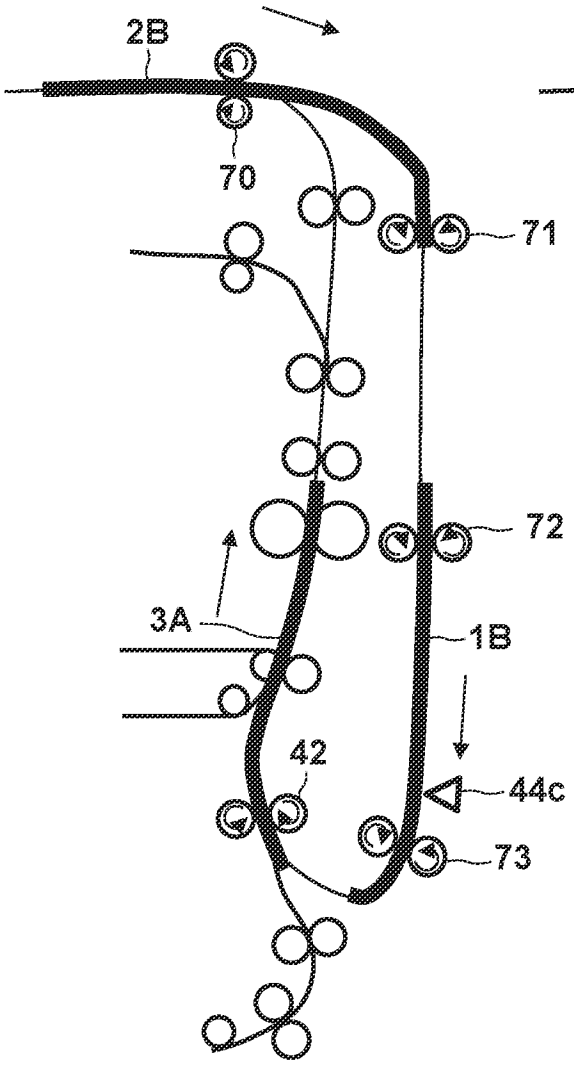

FIG. 6 is a flowchart illustrating a main conveyance process. FIG. 7 is a flowchart that illustrates image formation with respect to a second surface. FIG. 8 is a flowchart illustrating a recovery process. FIG. 9A and FIG. 9B illustrate conveyance of three sheets in a normal operation where waiting at the registration rollers 42 is not performed. FIG. 10A, FIG. 10B, and FIG. 10C illustrate conveyance of three sheets in a wait operation where waiting at the registration rollers 42 is performed. An operator sets a print job from the console 203 or a host computer, and instructs the CPU 201 to execute the print job. When the print job is inputted, the CPU 201 executes the following processing.

In step S601, the CPU 201 controls the motor M3 for driving the feed mechanism 32 to start feeding of a sheet P. With this, the sheet P is conveyed from the container 31 to the registration rollers 42. The CPU 201 causes the motor M4 to decelerate in response to the sheet sensor 44*a* detecting the leading end of the sheet P, and starts deceleration of the conveyance speed (a circumferential speed) of the registration rollers 42. The feed mechanism 32 does not decelerate, and thus a loop is formed in the sheet P.

In step S602, the CPU 201 determines whether or not image writing is permitted. Image writing permission is managed in accordance with the aforementioned flag that is held in the memory 202, for example. If image writing is not permitted, the CPU 201 advances the processing to step S603. In step S603, the CPU 201 controls the motors M3 and M4 to cause the sheet P to wait at the registration rollers 42. With this, the sheet P stops while abutting the registration rollers 42, and a loop is formed near the leading end of the sheet P. Subsequently, the CPU 201 advances the processing to step S602. Meanwhile, when image writing is permitted in step S602, the CPU 201 advances the processing to step S604.

In step S604, the CPU 201 controls the image forming unit 2 to form and fix an image on the first surface of the sheet P.

In step S605, the CPU 201 analyzes the print job, and determines whether duplex printing (image formation to the second surface) has been designated. If duplex printing is not designated, the CPU 201 advances the processing to step S607. In step S607, the CPU 201 controls the flapper 64 and the discharge rollers 62 to discharge to the discharge tray 80 the sheet P to which an image was formed to the first surface thereof. In step S608, the CPU 201 analyzes the print job to determine whether or not there is a succeeding sheet. If there is no succeeding sheet, the CPU 201 ends the print job. If there is a succeeding sheet, the CPU 201 returns to step S601, and executes feeding for the succeeding sheet, and the like.

Meanwhile, if duplex printing is designated in step S605, the CPU 201 advances the processing to step S606. Step S606 is image formation to the second surface, and details thereof are illustrated by FIG. 7. Here, the sheet P to which an image is to be formed to the second surface thereof is represented as a sheet of interest. This is to distinguish the sheet of interest with respect to a preceding sheet that is being conveyed in advance of the sheet of interest, and a succeeding sheet that is being conveyed after the sheet of interest. Note that, seen from the succeeding sheet the sheet of interest is the preceding sheet. Seen from the preceding sheet, the sheet of interest is the succeeding sheet.

In step S701, the CPU 201 causes the motor M1 to rotate forward and rotate backward to thereby reverse the front and back of the sheet of interest. As described above, the sheet of interest is conveyed to the conveyance path r4 after being pulled inside the conveyance path r3 from the conveyance path r2. Upon detecting the trailing end of the sheet of interest by the sheet sensor 44*b*, the CPU 201 switches the rotational direction of the motor M1 from forward rotation to backward rotation. Note that reversal of front and back refers to a sheet surface in contact with the intermediate transfer belt 21 changing from the first surface to the second surface.

In step S702, the CPU 201 determines whether the preceding sheet is waiting at the registration rollers 42 when the sheet of interest reaches the second rollers 72. The CPU 201, may determine that the sheet of interest has reached the second rollers 72 based on an amount of time that has elapsed from when the rotational direction of the motor M1 changes from forward rotation to backward rotation. Alternatively, the CPU 201 may determine that the sheet of interest has reached the second rollers 72 by using a sheet sensor (not shown) that is provided on an upstream side of the second rollers 72. The CPU 201 may determine that the preceding sheet is waiting at the registration rollers 42 based on a detection result by the sheet sensor 44*a*. If the preceding sheet is not waiting at the registration rollers 42, the CPU 201 advances the processing to step S703.

In step S703, the CPU 201 controls the motor M2 to convey the sheet of interest by the second rollers 72. FIG. 9A illustrates a conveyance state of the sheet 2B which is a sheet of interest when the sheet 1B which is the preceding sheet is not waiting at the registration rollers 42. Note that the CPU 201 conveys the sheet 1B to the registration rollers 42 so that the image formation interval between the sheet 1B and the sheet 3A which is conveyed on the conveyance path r1 becomes a prescribed interval. Here, it is assumed that writing of an image to be formed on the second surface of the sheet 1B is permitted.

In step S704, the CPU 201 controls the image forming unit 2 to form and fix an image on the second surface of the sheet 1B which is the preceding sheet. FIG. 9B illustrates positions of sheets for when the sheet 2B which is the sheet of interest has reached the second rollers 72. The leading end of the sheet 2B which is the sheet of interest has passed through the secondary transfer unit 3. Meanwhile, upon determining that the preceding sheet is waiting in step S702, the CPU 201 advances the processing to step S711.

In step S711, the CPU 201 controls the motor M2 to cause the sheet of interest to wait. By this, the sheet of interest will not collide with the preceding sheet. There are cases where image writing to be formed on the sheet 1B has not been permitted when the sheet 1B which is the preceding sheet has reached a position illustrated by FIG. 10A (downstream of the third rollers 73). In such a case, as illustrated by FIG. 10B, the sheet 1B waits while abutting the registration rollers 42. Here, a loop is formed in a leading end region of the sheet 1B. In parallel with this, when the sheet 2B which is the sheet of interest reaches the second rollers 72, the second rollers 72 rotate by only a predetermined amount and then stop. Stoppage of the sheet 2B is due to stoppage of the conveyance of the sheet 1B. This is because both are being conveyed by the motor M2. As illustrated by FIG. 10B, the leading end of the sheet 2B abuts a nip portion of the second rollers 72, and a loop is also formed in a leading end region of the sheet 2B. This is because the motor M1 continues to drive the first rollers 71 even though the motor M2 is stopped.

In step S712, the CPU 201 determines whether or not image writing to be formed on the preceding sheet is permitted. When a predetermined amount of time elapses and image writing to be formed on the preceding sheet (the sheet 1B) is permitted, the CPU 201 advances the processing to step S713.

In step S713, the CPU 201 resumes conveyance of the preceding sheet (the sheet 1B) and the sheet of interest (the sheet 2B). As illustrated by FIG. 10C, the CPU 201 drives the motors M2 and M4 again to thereby resume conveyance of the sheet 1B and the sheet 2B. In other words, the two sheets 1B and 2B that were waiting in the conveyance path r4 can be conveyed by the single motor M2.

Figure 11:
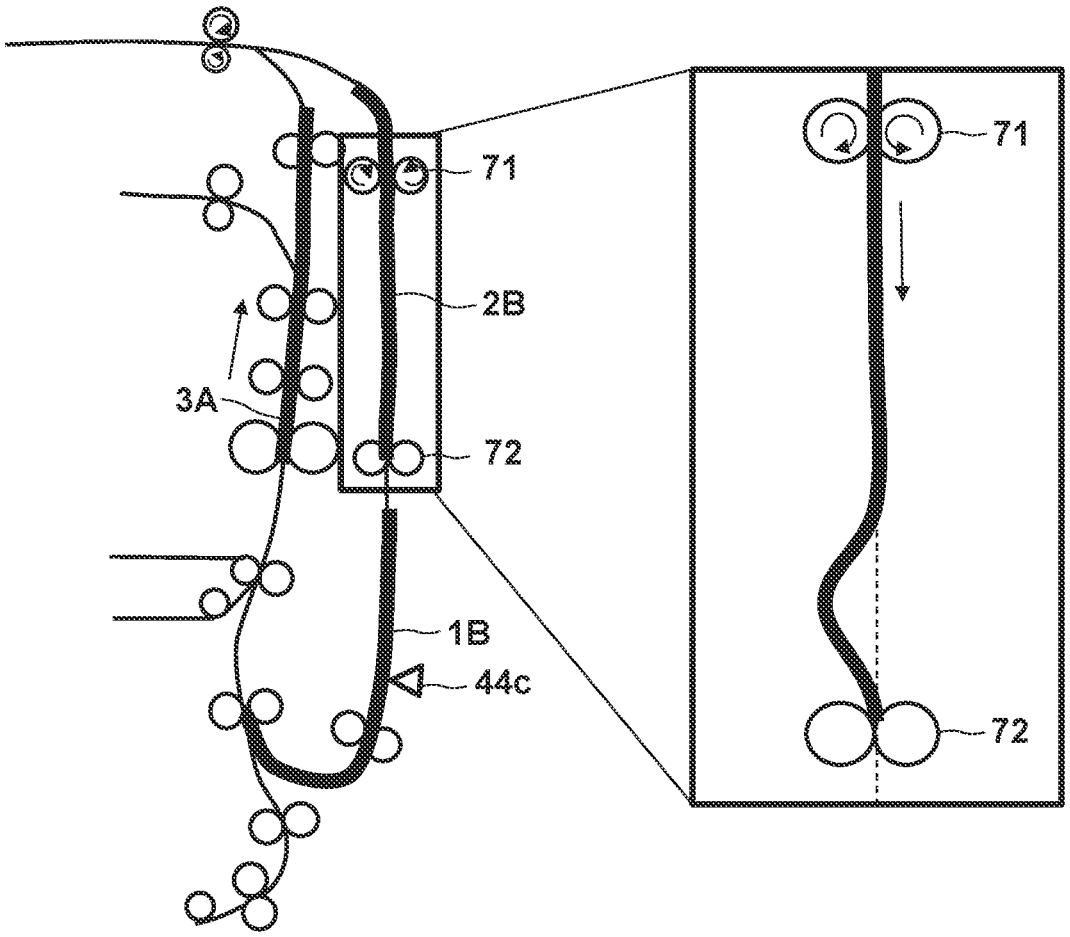
FIG. 11 is a view for describing formation of a loop at second rollers.

As illustrated by FIG. 11, the second rollers 72 can correctly convey the sheet 2B even if the sheet 2B does not exceed a center of a nipping portion of the second rollers 72. Conveyance of the sheet 3A which is the succeeding sheet can be controlled independently from conveyance of the sheet 2B. In other words, as illustrated by FIG. 3C, the sheet 3A is conveyed by the motor M1, and the sheets 1B and 2B are conveyed on the conveyance path r4 by the motor M2. Accordingly, it is possible to cause three sheets to wait and restart on the conveyance path r3 and the conveyance path r4 by only the two motors M1 and M2.

In step S714, the CPU 201 executes a recovery process for the sheet of interest. Details of the recovery process are described later.

In step S715, the CPU 201 determines whether or not image writing to be formed on the second surface of the sheet of interest is permitted. If image writing is not permitted, the CPU 201 advances the processing to step S716.

In step S716, the CPU 201 stops the registration rollers 42 and causes the sheet of interest to wait at the registration rollers 42. At this point, because the motor M2 is rotating, the sheet of interest abuts the registration rollers 42 and a loop is formed. If image writing is permitted, the CPU 201 advances the processing to step S704. In step S704, the CPU 201 forms an image on the second surface while conveying the sheet of interest by the registration rollers 42.

Note that there are cases where the sheet 2B that is the sheet of interest that was restarted in step S713 does not reach the sheet sensor 44*c*. In such a case, a recovery process is executed.

Figure 12A:
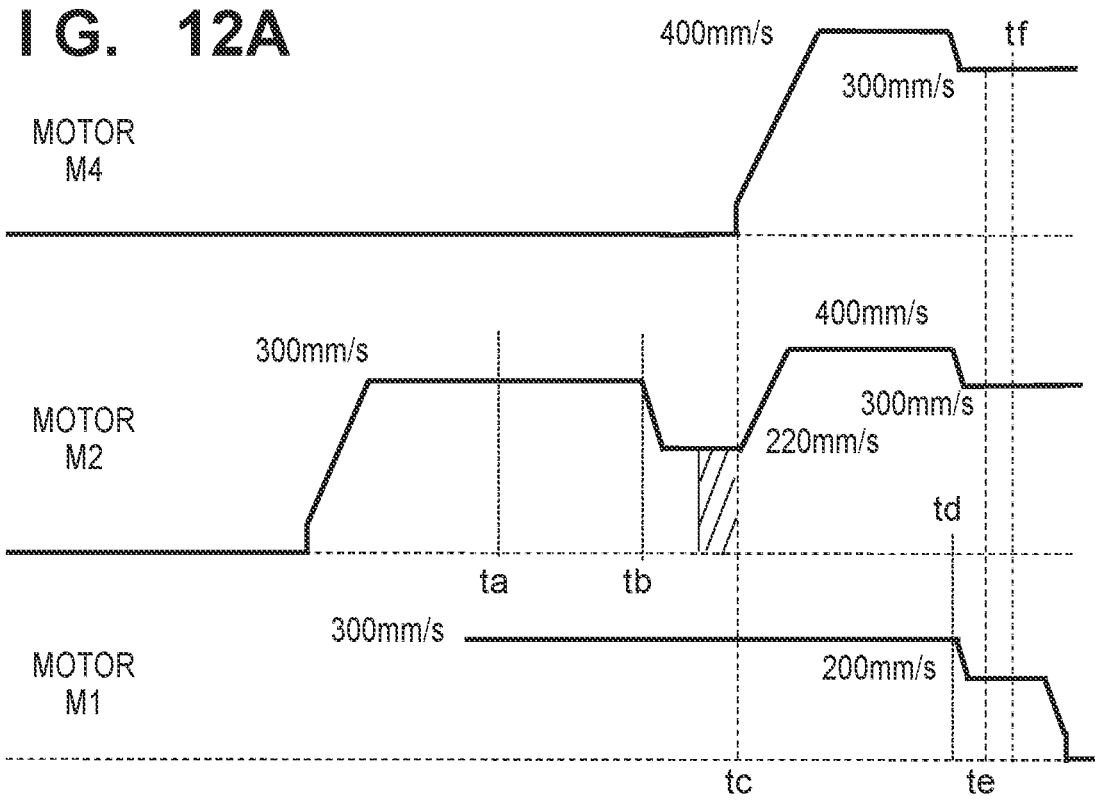
FIGS. 12A and 12B are views for describing driving timings of driving sources.

FIG. 12A illustrates driving timings for the motors M1, M2, and M4 in a case of No in step S702. Firstly, movement of the preceding sheet (the sheet 1B) is described. When the sheet 1B abuts the registration rollers 42 and a loop is formed on the sheet 1B, a conveyance speed V1 of the sheet 1B in accordance with the motor M2 is 220 [mm/s]. Note that the CPU 201 determines whether or not to write an image at a time tb after a predetermined amount of time has elapsed from a time to when the sheet sensor 44*a* detected the sheet 1B. In addition, the CPU 201 decelerates the conveyance speed in accordance with the motor M2 at the time tb. The CPU 201 does not stop the motor M2, and causes the motor M2 to accelerate again at a time tc.

Next, conveyance of the sheet of interest (the sheet 2B) is described. The CPU 201 drives the motor M1 to rotate the first rollers 71, and convey the sheet 2B. At a time td when the sheet 2B enters the second rollers 72, the CPU 201 decelerates the conveyance speed of the motor M1 from 300 [mm/s] to V2 (=200 [mm/s]). Here, V1≥V2, and the one-way clutch 76 is provided between the motor M1 and the first rollers 71. Accordingly, at a time te, the sheet 2B, concurrent with entering the second rollers 72, is pulled from the first rollers 71 by the second rollers 72. Accordingly, it is possible to convey the preceding sheet (the sheet 1B) and the sheet of interest (the sheet 2B) by the motor M2. The sheet 1B enters the secondary transfer unit 3 at a time tf. In order for the reversal rollers 70 to accept the succeeding sheet (the sheet 3B), the motor M1 switches from backward rotation to forward rotation.

Figure 12B:
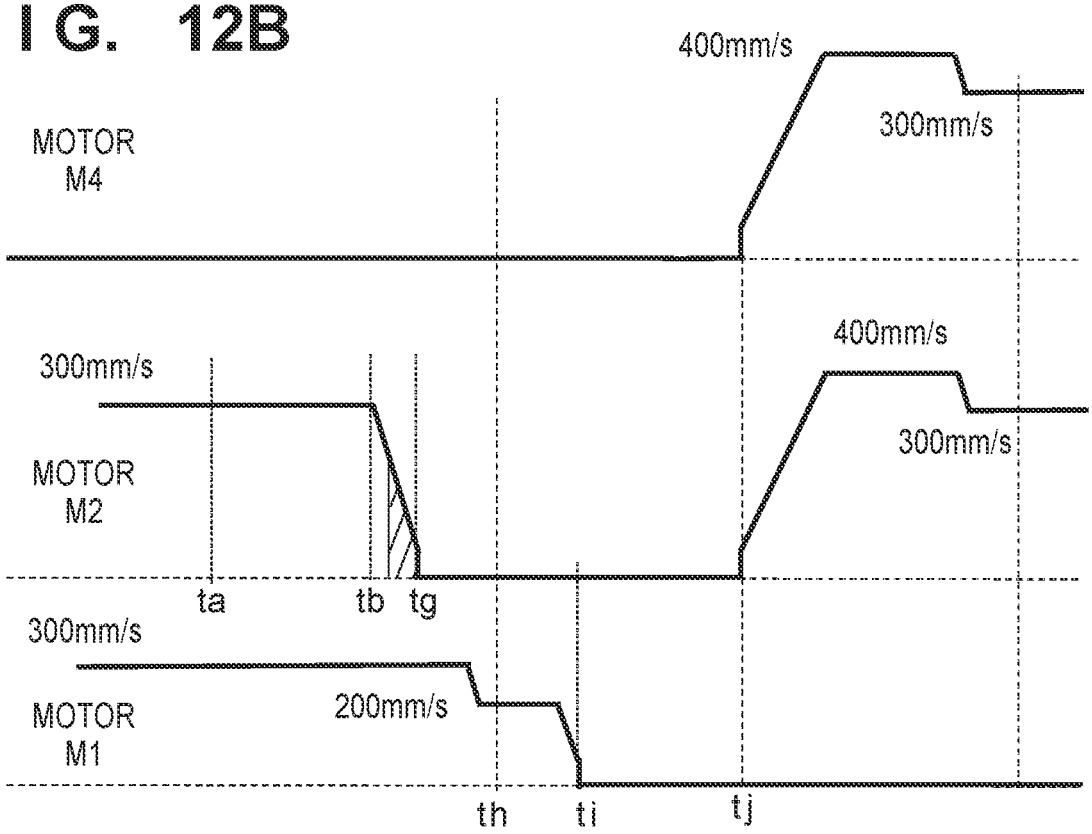

FIG. 12B illustrates driving timings for the motors M1, M2, and M4 in a case of Yes in step S702. Firstly, movement of the preceding sheet (the sheet 1B) is described. The sheet sensor 44*a* detects the sheet 1B at the time ta, and the CPU 201 determines whether to permit image writing at the time tb. When image writing is not permitted, the CPU 201 maintains the conveyance speed of the motor M2 at V1 (=300 [mm/s]). The CPU 201 temporarily stops the motor M2 at a time tg when it should be the case that a predetermined loop has been formed in the sheet 1B. The CPU 201 accelerates the motor M2 again at a time tj.

Next, conveyance of the sheet of interest (the sheet 2B) is described. The CPU 201 rotates the motor M1 in reverse to drive the first rollers 71 and convey the sheet 2B by the first rollers 71. At a time th when the sheet 2B enters the second rollers 72, the CPU 201 decelerates the conveyance speed of the motor M1 from 300 [mm/s] to V2 (=200 [mm/s]). The CPU 201 stops the motor M1 at a time ti when the leading end of the sheet 2B has advanced a predetermined distance from the second rollers 72. Here, because the motor M2 (the second rollers 72) stopped at the time ti, the leading end of the sheet 2B stops without passing through the second rollers 72.

In order to resume conveyance of the preceding sheet (the sheet 1B) which is already stopped, the CPU 201 sets the conveyance speed of the motor M4 and the motor M2 to 400 [mm/s] at a time tj, to drive each of these again. Consequently, conveyance of the preceding sheet (the sheet 1B) and the sheet of interest (the sheet 2B) is restarted.

[Recovery Process]

FIG. 8 illustrates details of the recovery process. FIG. 13A through FIG. 13D, FIG. 14A, and FIG. 14B illustrate positions of respective sheets in the recovery process. FIG. 15 illustrates driving timings for respective motors in the recovery process.

Figure 13A:
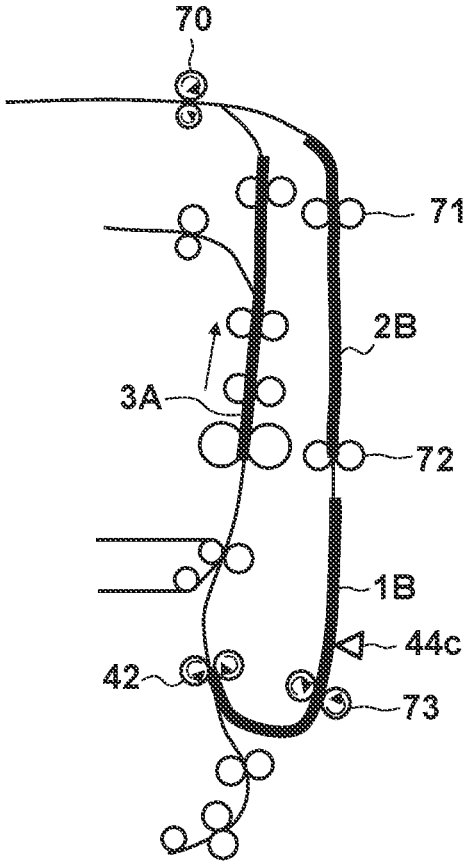
FIGS. 13A to 13D are views for describing positions of sheets and rotation and stoppage of rollers.
Figure 13B:
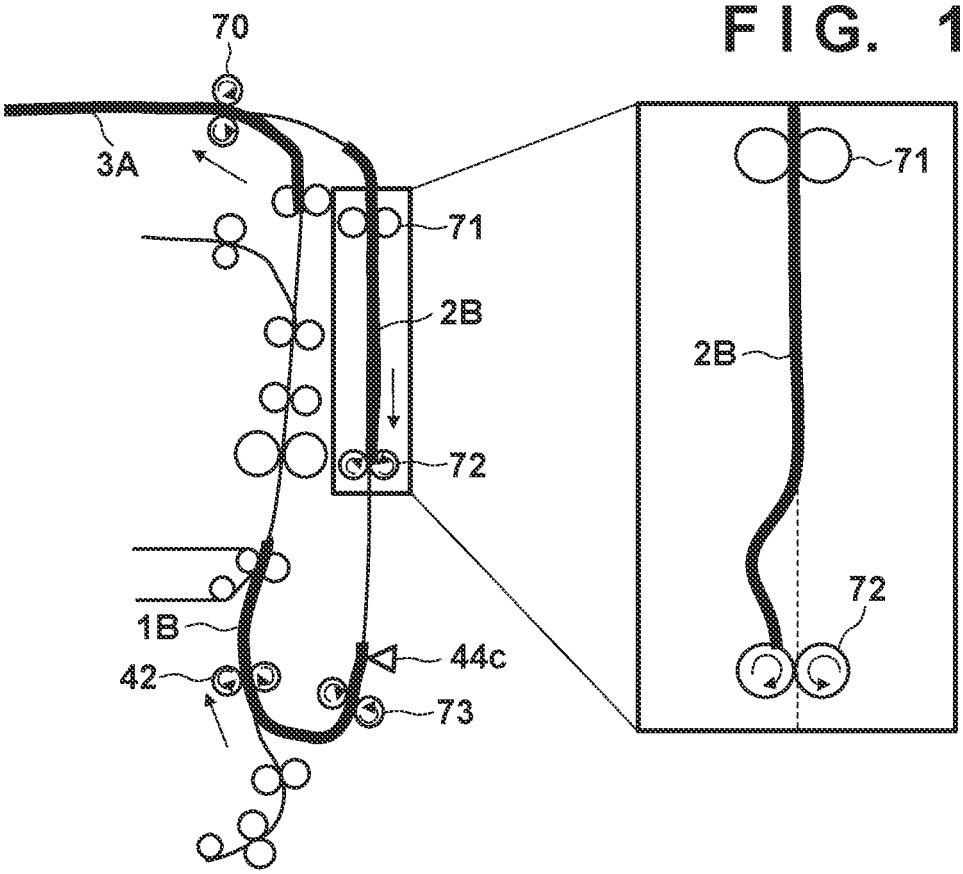

In step S801, the CPU 201 determines whether or not a succeeding sheet is being conveyed after a sheet of interest. FIG. 13A illustrates an arrangement of sheets at a time of this determination. There is the sheet 3A which is a succeeding sheet with respect to the sheet 2B. In this case, the CPU 201 advances the processing to step S802.

In step S802, the CPU 201 determines whether the trailing end of the preceding sheet (the sheet 1B), which is in advance of a sheet of interest (the sheet 2B) has passed a predetermined position, based on a result of detection by the sheet sensor 44*c*. The predetermined position is a detection position of a sheet P by the sheet sensor 44*c*. When the detection result by the sheet sensor 44*c* changes from on to off, the CPU 201 causes a timer to start and advances the processing to step S803.

In step S803, the CPU 201 determines whether the sheet of interest (the sheet 2B) has passed the predetermined position based on the detection result by the sheet sensor 44*c*. For example, if the detection result by the sheet sensor 44*c* has not changed from off to on, the CPU 201 advances the processing to step S804. When the detection result of the sheet sensor 44*c* changes from off to on, the CPU 201 ends the recovery process. When restart of the sheet 2B succeeds, the sheet 2B is conveyed by the second rollers 72 and reaches the sheet sensor 44*c*. Accordingly, the detection result by the sheet sensor 44*c* switches from off to on.

In step S804, the CPU 201 determines whether a predetermined amount of time T has elapsed. When an amount of time measured by the timer exceeds the predetermined amount of time T, the CPU 201 advances the processing to step S805. When an amount of time measured by the timer does not exceed the predetermined amount of time T, the CPU 201 returns the processing to step S803. In other words, when the sheet 2B reaches the sheet sensor 44*c* before the predetermined amount of time T elapses, the CPU 201 determines that restart of the sheet 2B has succeeded. In this way, step S803 and step S804 are processing for determining success of restart of the sheet 2B. The predetermined amount of time T is an amount of time that is twice the amount of time obtained by dividing the distance from a position where the leading end of the sheet 2B stops when the restart of the sheet 2B starts until the detection position of the sheet sensor 44*c*, by the conveyance speed of the motor M2, for example.

There are several reasons why a restart of the sheet 2B fails. As illustrated by FIG. 13A, the sheet 2B abuts the second rollers 72 in step S711. As illustrated by the magnification view of FIG. 13B, the leading end of the sheet 2B has stopped without entering the nipping portion of the second rollers 72. In this way, when the leading end of the sheet 2B is not nipped by the second rollers 72, a restart of the sheet 2B may fail.

In step S805, the CPU 201 stops the motor M2. Consequently, the second rollers 72 and the third rollers 73 stop.

Figure 13C:
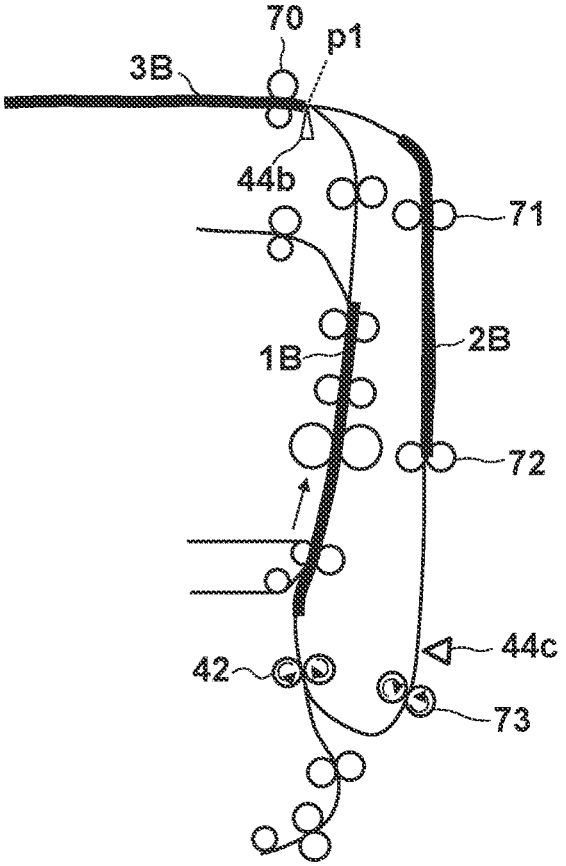

In step S806, the CPU 201 determines whether the succeeding sheet (the sheet 3B) following the sheet of interest has reached a reversal position p1. Note that, because conveyance direction of the sheet 3A is changed from the first direction to the second direction, the sheet 3A is represented as the sheet 3B. FIG. 13C indicates the sheet 3B having reached the reversal position p1. When a detection result by the sheet sensor 44*b* switches from on to off, the CPU 201 determines that the succeeding sheet (the sheet 3B) has reached the reversal position p1, and advances the processing to step S807.

Figure 13D:
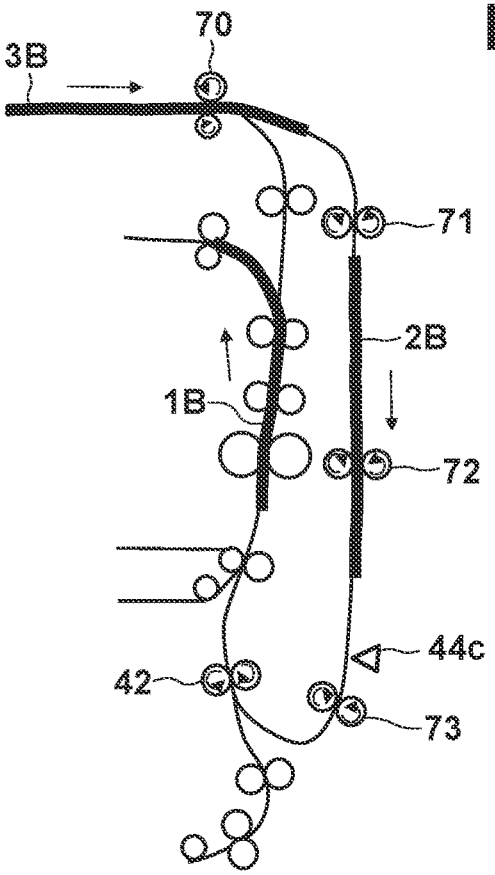

In step S807, the CPU 201 drives the motor M2 again to thereby perform recovery for the restart of the sheet 2B. In step S808, the CPU 201 also drives (reverse rotation) the motor M1 to convey the succeeding sheet (the sheet 3B) to the conveyance path r4. In the restart first executed in step S713, the sheet 2B is conveyed by only the motor M2. In other words, the first rollers 71 merely rotate due to the sheet 2B, and the second rollers 72 solely convey the sheet 2B downstream. In contrast, as illustrated by FIG. 13D, in the second restart in accordance with step S807 and step S808, the motor M2 and the motor M1 convey the sheet 2B. In other words, the first rollers 71 and the second rollers 72 convey the sheet 2B downstream. Accordingly, the probability of success in restarting the sheet 2B improves.

Figure 14A:
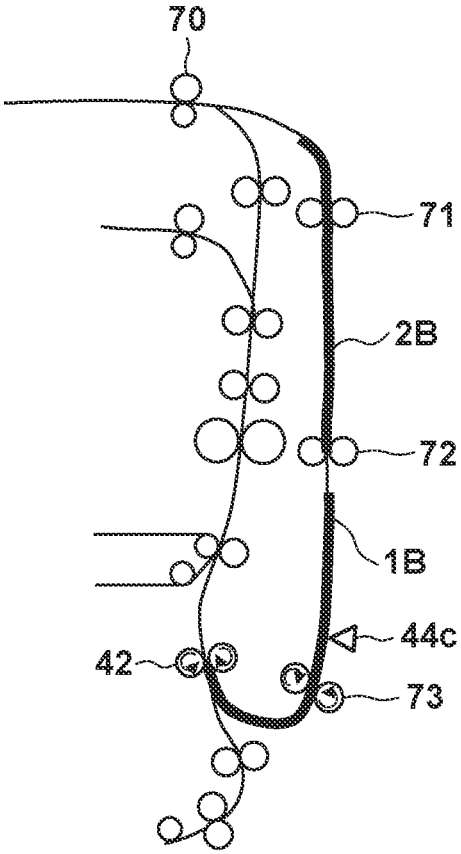
FIGS. 14A and 14B are views for describing positions of sheets and rotation and stoppage of rollers.
Figure 14B:
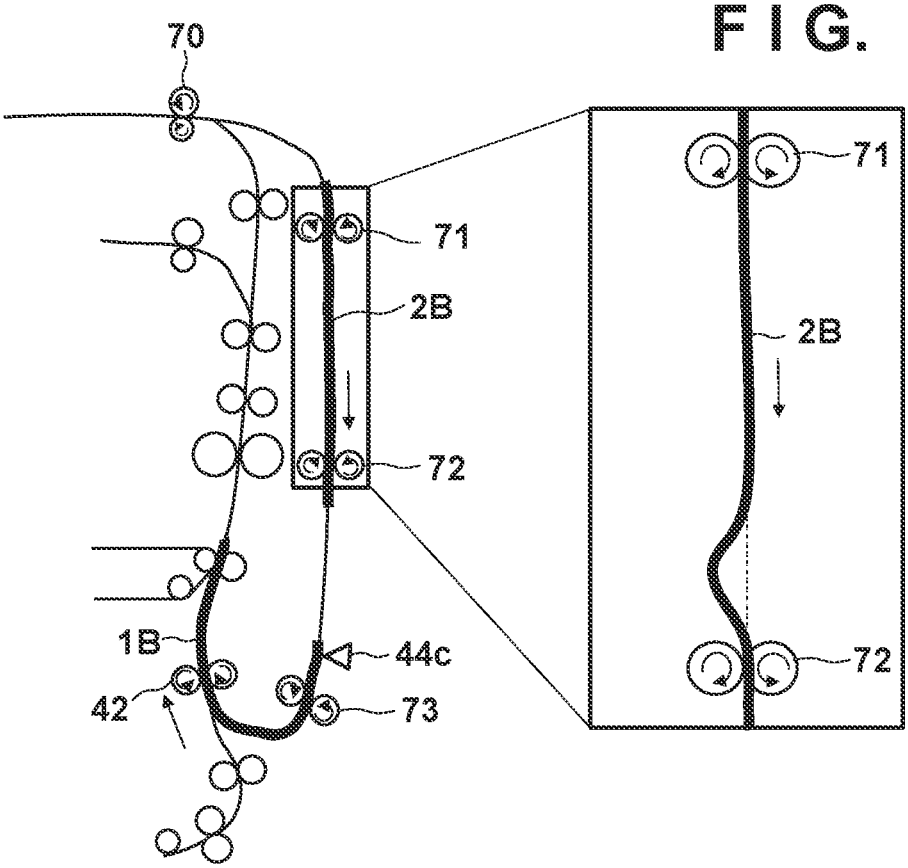
Figure 15:
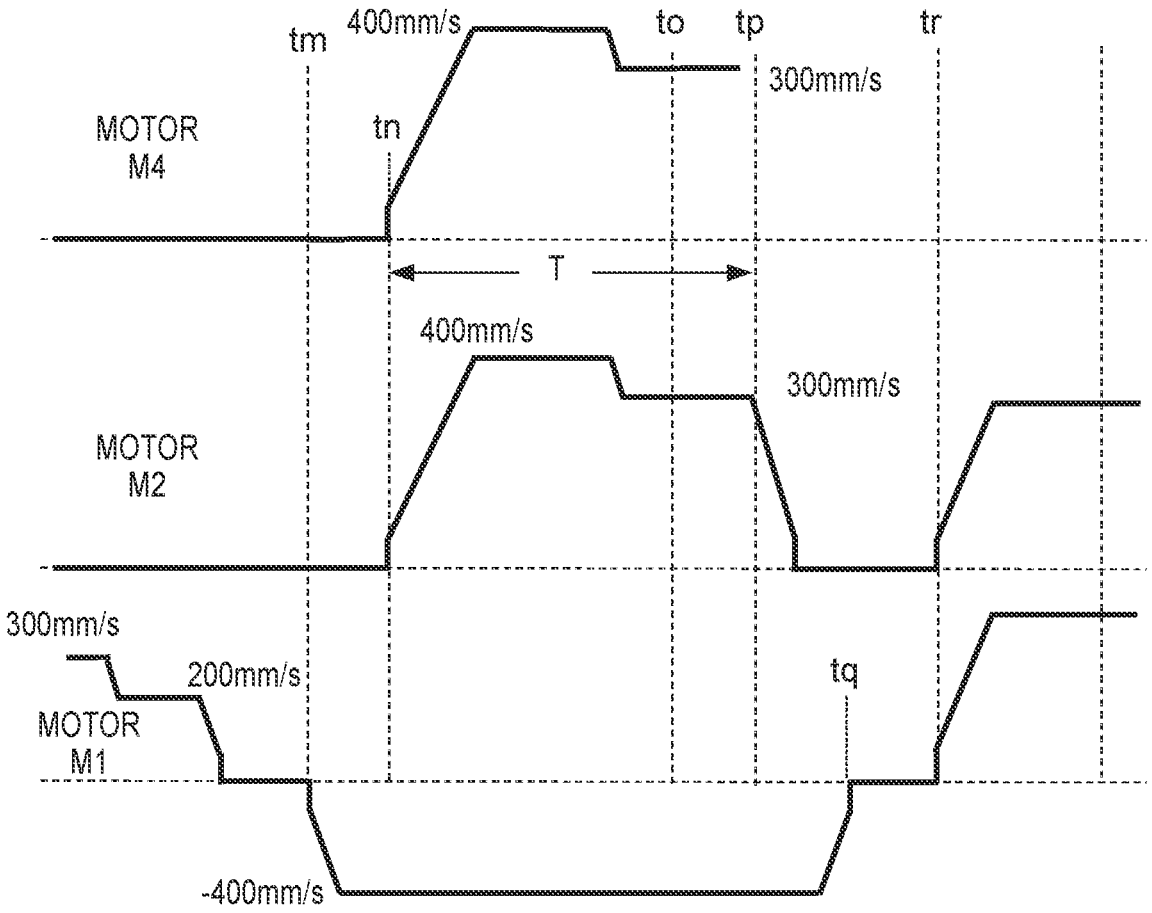
FIG. 15 is a view for describing driving timings of driving sources.

FIG. 14A illustrates an arrangement of sheets in a case where there is no succeeding sheet. Upon determining in step S801 that there is no succeeding sheet for the sheet 2B, the CPU 201 advances the processing to step S808. In step S808, the motor M1 is driven. In step S713, the motor M2 is already rotating. Accordingly, as illustrated by FIG. 14B, the motors M1 and M2 (the first rollers 71 and the second rollers 72) cooperate to restart conveyance of the sheet 2B. Accordingly, the probability of success in restarting the sheet 2B improves.

FIG. 15 illustrates driving timings of respective motors.

Preceding Sheet (Sheet 1B)

At a time tn, the CPU 201 starts driving the motors M2 and M4 to restart the preceding sheet (the sheet 1B). The conveyance speed by the motors M2 and M4 is set to 400 [mm/s]. At a time to immediately before the leading end of the sheet 1B enters the secondary transfer unit 3, the CPU 201 sets the conveyance speed by the motors M2 and M4 to 300 [mm/s].

Sheet of Interest (the Sheet 2B)

The second rollers 72 rotate in accordance with the motor M2 which is activated to restart the preceding sheet (the sheet 1B). Consequently, the second rollers 72 pull out the sheet of interest (the sheet 2B) from the first rollers 71. Here, the detection result of the sheet sensor 44*c* does not change from off to on until the predetermined amount of time T elapses. Accordingly, at the time tp, the CPU 201 stops the motor M2 in step S805.

Succeeding Sheet (the Sheet 3A)

At a time tm when the succeeding sheet (the sheet 3A) enters the reversal rollers 70, the CPU 201 drives the motor M1 at −400 [mm/s]. At a time tq when 20 [mm] from the trailing end of the sheet 3A has not yet entered the reversal rollers 70, the CPU 201 stops the motor M1.

Recovery

At a time tr, the CPU 201 sets the conveyance speed by the motors M1 and M2 to 300 [mm/s], and drives the motors M1 and M2. Consequently, the sheet 2B is conveyed by the second rollers 72 and the first rollers 71.

SUMMARY

The container 31 is an example of a container unit for containing sheets P. The image forming unit 2 formed by the intermediate transfer belt 21 and the like is an example of an image forming unit for forming an image on a sheet P. The discharge rollers 62 are an example of a discharge unit for discharging a sheet P onto which an image has been formed. The conveyance path r1 is an example of a main conveyance path from the container 31 and reaches the discharge rollers 62 via the image forming unit 2. The conveyance path r2 is an example of an auxiliary conveyance path that divides from the conveyance path r1 and is for pulling a sheet P to which an image has been formed on a first surface thereof in order to form an image on a second surface of the sheet P. The conveyance path r3 is an example of a reversing and conveying path that is connected to the conveyance path r2 and is for reversing a conveyance direction of a sheet P to which an image has been formed on a first surface thereof. The conveyance path r4 is an example of a sub conveyance path for conveying a sheet P that has been fed from the conveyance path r3 and onto which an image has been formed on a first surface thereof to the conveyance path r1 in order to refeed the sheet P to the image forming unit 2. The sub conveyance path may be referred to as a duplex conveyance path. The registration rollers 42 are rollers that are provided on a downstream side of a joining portion of the conveyance path r1 and the conveyance path r4, and an upstream side of the image forming unit 2 in the conveyance direction of the sheet P in the conveyance path r1. The reversal rollers 70 are rollers that convey in a first direction a sheet P onto a first surface of which an image has been formed to thereby pull the sheet P into the conveyance path r3, and convey the sheet P in a second direction opposite to the first direction to thereby feed the sheet P to the conveyance path r4. The first rollers 71 are rollers that are provided on a downstream side of a connection point between the conveyance path r3 and the conveyance path r4 in the conveyance path r4, and are for conveying a sheet P passed from the reversal rollers 70. The motor M1 is a first motor for driving the reversal rollers 70 and the first rollers 71. The one-way clutch 76 restricts a transfer of the driving force from the motor M1 to the first rollers 71 while the reversal rollers 70 are conveying a sheet P in the first direction. The one-way clutch 76 permits a transfer of the driving force from the motor M1 to the first rollers 71 while the reversal rollers 70 are conveying the sheet in the second direction. The second rollers 72 are rollers that are provided on a downstream side of the first rollers 71 in the conveyance direction of a sheet P in the conveyance path r4. The third rollers 73 are an example of third rollers provided in the conveyance path r4 on a downstream side of the second rollers 72 in the conveyance direction of the sheet P. The motor M2 is a second motor for driving the second rollers 72 and the third rollers 73. The sheet sensor 44*c* is provided in the conveyance path r4 between the second rollers 72 and the third rollers 73, and is an example of a detection unit or a sheet detector for detecting a sheet P that has passed through the second rollers 72. The CPU 201 is a controller for controlling the motors M1 and M2. The CPU 201 drives both of the motor M1 and the motor M2 at a time of resuming conveyance of a sheet P that was conveyed on the conveyance path r4 after causing the sheet P to wait abutting the second rollers 72. In this way, a restart of a sheet P is executed in accordance with both of the motor M1 and the motor M2. Accordingly, the present embodiment can reduce failures of conveyance in a conveyance path for duplex printing while reducing the number of driving units necessary in the conveyance path.

The CPU 201 may have a first determination unit for determining whether an i-th sheet being conveyed in advance of an i+1-th sheet is waiting at the registration rollers 42, when an i+1-th sheet is traveling toward the second rollers 72 (step S702). The CPU 201 may cause the i+1-th sheet to wait abutting the second rollers 72 in a case where the i-th sheet is waiting at the registration rollers 42 (step S711). In addition, the CPU 201 may convey the i+1-th sheet by the second rollers 72 without causing the i+1-th sheet to wait at the second rollers 72 in a case where the i-th sheet is not waiting at the registration rollers 42 (step S703). The CPU 201 may resume conveyance of the i+1-th sheet by the second rollers 72 when the registration rollers 42 resume conveyance of the i-th sheet (step S713).

The CPU 201 may have a second determination unit for determining whether there is an i+2-th sheet succeeding the i+1-th sheet, when the CPU 201 resumes driving by the motor M2 to resume conveyance of the i+1-th sheet by the second rollers 72 (step S801). The CPU 201 may drive the motor M1 again if the i+2-th sheet is not present (step S808). The CPU 201 may determine whether resumption of conveyance of the i+1-th sheet has succeeded, based on a detection result by the sheet sensor 44*c*, if the i+2-th sheet is present (step S802). Furthermore, the CPU 201 may continue conveyance of the i+1-th sheet by the motor M2 without driving the motor M1 again if resumption of conveyance of the i+1-th sheet succeeds (Yes in step S803).

The CPU 201 may have a third determination unit for determining whether resumption of conveyance of the i+1-th sheet succeeded within a predetermined amount of time, based on a detection result by the sheet sensor 44*c* (step S803 and step S804). The CPU 201 may stop the motor M2 if resumption of conveyance of the i+1-th sheet does not succeed within the predetermined amount of time (step S805). Furthermore, the CPU 201 may resume driving by the motor M2 and driving by the motor M1 when the i+1-th sheet reaches a portion for connecting the conveyance path r3 and the conveyance path r4 (step S807 and step S808).

The CPU 201 may control the motor M1 and the motor M2 so that a loop is formed in a leading end portion of the i+1-th sheet, if the i+1-th sheet is caused to wait abutting the second rollers 72 (step S711). By this, skewing of the i+1-th sheet is corrected. For example, the CPU 201 may reduce the rotation speed of the motor M2 when the i+1-th sheet abuts the second rollers 72 so that a loop is formed in a leading end portion of the i+1-th sheet. For example, the CPU 201 may reduce the rotation speed of the motor M2 to reduce the circumferential speed of the second rollers 72 below the circumferential speed of the first rollers 71, when the i+1-th sheet abuts the second rollers 72. By this, a loop occurs because the conveyance speed of a leading end region of the sheet is reduced to be less than the conveyance speed of a trailing end region.

The length of the conveyance path r3 and the conveyance path r4 may be a length in which three A4 size sheets or letter size sheets can wait. The preceding sheet as described above in FIG. 7 or FIG. 8 is the i-th sheet. The sheet of interest is the i+1-th sheet. The succeeding sheet is the i+2-th sheet. Here, i is an integer that indicates an order in which sheets are fed from the container 31.

Note that the registration rollers 42 are an example of a rotary member. The reversal rollers 70 are an example of a reversal unit or a first rotary member. The first rollers 71 are an example of a first conveyance unit or a second rotary member. The second rollers 72 are an example of a second conveyance unit or a third rotary member. The third rollers 73 are an example of a third conveyance unit or a fourth rotary member. The motor M1 is an example of a first driving unit. The motor M2 is an example of a second driving unit. The one-way clutch 76 is an example of a restricting unit.

In the above embodiment, the number of conveyance rollers driven by the motor M1 and the motor M2 was two for each, but it may be three or more in the present invention. For example, other conveyance rollers driven by the motor M2 may be added between the third rollers 73 and the second rollers 72. Other conveyance rollers driven by the motor M1 may be added between the reversal rollers 70 and the first rollers 71. However, if the distance between other conveyance roller that was added and the second rollers 72 is shorter than a sheet length (the length of a sheet in the conveyance direction of the sheet), a drive blocking member such as a one-way clutch becomes necessary.

FIG. 12A and FIG. 12B show specific conveyance speeds, but these are merely exemplary. In FIG. 12A, a loop is formed without a sheet P which is conveyed on the conveyance path r4 stopping at the registration rollers 42. In other words, the motor M2 merely reduces the conveyance speed temporarily. In addition, a sheet P is accelerated at the time tc. However, the motor M2 may first stop the sheet P as illustrated by FIG. 12B.

The motors M1 and M2 are employed as driving sources for conveyance rollers arranged on the conveyance path r3 and the conveyance path r4, but the present invention is not limited to this. For example, the motors M1 and M2 may be replaced by a shared motor. In such a case, a single electromagnetic clutch is provided on a transfer path for transferring a driving force to a conveyance roller provided on the conveyance path r4. The CPU 201 ascertains the position of each sheet based on a detection result by a sheet sensor, and switches connection/blocking of the electromagnetic clutch in accordance with the position of each sheet. Even if the electromagnetic clutch is counted as an actuator similarly to motors, in the present invention, the number of actuators is less than the number of sheets that wait in the conveyance path r3 and the conveyance path r4.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-228307, filed Nov. 28, 2017 which is hereby incorporated by reference herein in its entirety.

What is claimed is:

1. An image forming apparatus, comprising:

a container unit configured to contain a sheet;

an image forming unit configured to form an image on the sheet;

a discharge unit configured to discharge the sheet onto which the image was formed;

a main conveyance path, on which a sheet is conveyed, from the container unit to the discharge unit via the image forming unit;

an auxiliary conveyance path that divides from the main conveyance path, wherein a sheet to which an image has been formed on a first surface thereof is conveyed on the auxiliary conveyance path in order to form an image on a second surface of the sheet;

a reversing and conveying path connected to the auxiliary conveyance path, wherein the sheet that has been conveyed from the auxiliary conveyance path is conveyed on the reversing and conveying path in order to reverse a conveyance direction of the sheet;

a duplex conveyance path joined to the main conveyance path, wherein the sheet fed from the reversing and conveying path is conveyed on the duplex conveyance path in order to form the image on the second surface of the sheet;

a registration roller provided in the main conveyance path, on a downstream side of a joining portion of the main conveyance path and the duplex conveyance path and on an upstream side of the image forming unit with respect to the conveyance direction of the sheet;

a reversal roller configured to pull the sheet to which the image is formed on the first surface into the reversing and conveying path by conveying the sheet in a first direction, and feed the sheet into the duplex conveyance path by conveying the sheet in a second direction opposite to the first direction;

a first roller provided in the duplex conveyance path on a downstream side of a connection point between the reversing and conveying path and the duplex conveyance path, and configured to convey a sheet conveyed from the reversal roller;

a first motor configured to drive the reversal roller and the first roller;

a one-way clutch configured to restrict transfer of a driving force from the first motor to the first roller while the reversal roller is conveying a sheet in the first direction, and permit transfer of a driving force from the first motor to the first roller while the reversal roller is conveying a sheet in the second direction;

a second roller provided in the duplex conveyance path and on a downstream side of the first roller in the conveyance direction of the sheet, and configured to convey the sheet;

a third roller provided in the duplex conveyance path and on a downstream side of the second roller in the conveyance direction of the sheet, and configured to convey the sheet;

a second motor configured to drive the second roller and the third roller;

a sheet detector provided between the second roller and the third roller in the duplex conveyance path, and configured to detect a sheet that has passed the second roller; and a controller configured to control the first motor and the second motor so as to drive both of the first motor and the second motor when resuming conveyance of a sheet conveyed on the duplex conveyance path after causing the sheet to await abutment with the second roller, wherein the controller controls the second motor such that a leading end portion of a first sheet stops at a first stop position, which is a position of the registration roller, and a leading end portion of a second sheet succeeding the first sheet stops at a second stop position, which is a position of the second roller, wherein the controller controls the second motor so as to resume conveyance of the first sheet stopped at the first stop position and the second sheet stopped at the second stop position, and controls the first motor such that the reversal roller rotates in the first direction to convey a third sheet succeeding the second sheet to the reversing and conveying path and the first roller does not rotate, and wherein the controller stops the second motor in a case in which the sheet detector does not detect the second sheet within a predetermined elapsed time since the conveyance of the second sheet was resumed, and after a trailing end portion of the third sheet stops at a third stop position, which is on an upstream side of the reversal roller with respect to the first direction, controls the first motor and the second motor such that the reversal roller conveys the third sheet in the second direction and the second sheet is conveyed to the first stop position using the first roller and the second roller.

2. The image forming apparatus according to claim 1, wherein the controller, in a case in which the first sheet does not exist on the duplex conveyance path and the second sheet is conveyed by the first roller, controls the first motor and the second motor such that the second sheet is conveyed to the first stop position without stopping at the second stop position.

3. The image forming apparatus according to claim 1, wherein the controller, in a case of causing the second sheet to stop at the second stop position, controls the first motor and the second motor so that a leading end portion of the second sheet bends.

4. The image forming apparatus according to claim 3, wherein the controller reduces a rotation speed of the second motor when the second sheet stops at the second stop position, so that the leading end portion of the second sheet bends.

5. The image forming apparatus according to claim 4, wherein, when the second sheet stops at the second stop position, the controller reduces the rotation speed of the second motor so that a circumferential speed of the second roller becomes lower than a circumferential speed of the first roller.

6. The image forming apparatus according to claim 1, wherein a length of the reversing and conveying path and the duplex conveyance path is a length in which three A4 size sheets or letter size sheets can be conveyed concurrently.

7. The image forming apparatus according to claim 1, further comprising:

a third motor configured to rotate the registration roller, wherein the controller controls the second motor and the third motor to resume the conveyance of the first sheet stopped at the first stop position.

8. An image forming apparatus comprising:

a container unit configured to contain a sheet;

an image forming unit configured to form an image on the sheet;

a discharge unit configured to discharge the sheet onto which the image was formed;

a main conveyance path, on which a sheet is conveyed, from the container unit to the discharge unit via the image forming unit;

an auxiliary conveyance path that divides from the main conveyance path, wherein a sheet to which an image has been formed on a first surface thereof is conveyed on the auxiliary conveyance path in order to form an image on a second surface of the sheet;

a reversing and conveying path connected to the auxiliary conveyance path, wherein the sheet that has been conveyed from the auxiliary conveyance path is conveyed on the reversing and conveying path in order to reverse a conveyance direction of the sheet;

a duplex conveyance path joined to the main conveyance path, wherein the sheet fed from the reversing and conveying path is conveyed on the duplex conveyance path in order to form the image on the second surface of the sheet;

a registration roller provided in the main conveyance path, on a downstream side of a joining portion of the main conveyance path and the duplex conveyance path and on an upstream side of the image forming unit with respect to the conveyance direction of the sheet;

a reversal roller configured to pull the sheet to which the image is formed on the first surface into the reversing and conveying path by conveying the sheet in a first direction, and feed the sheet into the duplex conveyance path by conveying the sheet in a second direction opposite to the first direction;

a first roller provided in the duplex conveyance path on a downstream side of a connection point between the reversing and conveying path and the duplex conveyance path, and configured to convey a sheet conveyed from the reversal roller;

a first motor configured to drive the reversal roller and the first roller;

a one-way clutch configured to restrict transfer of a driving force from the first motor to the first roller while the reversal roller is conveying a sheet in the first direction, and permit transfer of a driving force from the first motor to the first roller while the reversal roller is conveying a sheet in the second direction;

a second roller provided in the duplex conveyance path and on a downstream side of the first roller in the conveyance direction of the sheet, and configured to convey the sheet;

a third roller provided in the duplex conveyance path and on a downstream side of the second roller in the conveyance direction of the sheet, and configured to convey the sheet;

a second motor configured to drive the second roller and the third roller;

a sheet detector provided between the second roller and the third roller in the duplex conveyance path, and configured to detect a sheet that has passed the second roller; and a controller configured to control the first motor and the second motor so as to drive both of the first motor and the second motor when resuming conveyance of a sheet conveyed on the duplex conveyance path after causing the sheet to await abutment with the second roller, wherein the controller, in a case in which an i-th sheet is waiting at the registration roller while an i+1-th sheet succeeding the i-th sheet is being conveyed toward the second roller, causes the i+1-th sheet to await abutment with the second roller, and in a case in which the i-th sheet is not waiting at the registration roller while the i+1-th sheet is being conveyed toward the second roller, causes the i+1-th sheet to be conveyed by the second roller without causing the i+1-th sheet to wait at the second roller, wherein the controller resumes conveyance of the i+1-th sheet by the second roller in response to the registration roller resuming conveyance of the i-th sheet, and wherein the controller, in a case in which an i+2-th sheet succeeding the i+1-th sheet is not present upon resuming conveyance of the i+1-th sheet by the second roller by resuming driving by the second motor, drives the first motor again, and, in a case in which the i+2-th sheet is present, determines whether resumption of conveyance of the i+1-th sheet succeeded based on a detection result by the sheet detector, and, if resumption of conveyance of the i+1-th sheet succeeded, continues conveyance of the i+1-th sheet by the second motor without driving the first motor again.

9. The image forming apparatus according to claim 8, wherein the controller determines whether resumption of conveyance of the i+1-th sheet succeeded within a predetermined amount of time based on the detection result by the sheet detector, and, if resumption of conveyance of the i+1-th sheet did not succeed within the predetermined amount of time, stops the second motor, and, in response to the i+1-th sheet reaching a portion for connecting the reversing and conveying path and the duplex conveyance path, resumes driving of the second motor and driving of the first motor.

10. An image forming apparatus, comprising:

a container unit configured to contain a sheet;

an image forming unit configured to form an image on the sheet;

a discharge unit configured to discharge the sheet onto which the image was formed;

a main conveyance path, on which a sheet is conveyed, from the container unit to the discharge unit via the image forming unit;

a reversing and conveying path, wherein the sheet that has been conveyed from the main conveyance path is conveyed on the reversing and conveying path in order to reverse a conveyance direction of the sheet;

a duplex conveyance path joined to the main conveyance path, wherein the sheet fed from the reversing and conveying path is conveyed on the duplex conveyance path in order to form an image on a second surface of the sheet;

a rotary member provided in the main conveyance path, on a downstream side of a joining portion of the main conveyance path and the duplex conveyance path and on an upstream side of the image forming unit with respect to the conveyance direction of the sheet;

a reversal unit configured to pull the sheet to which the image is formed on the first surface into the reversing and conveying path by conveying the sheet in a first direction, and feed the sheet into the duplex conveyance path by conveying the sheet in a second direction opposite to the first direction;

a first conveyance unit provided in the duplex conveyance path on a downstream side of a connection point between the reversing and conveying path and the duplex conveyance path, and configured to convey a sheet conveyed from the reversal unit;

a first driving unit configured to drive the reversal unit and the first conveyance unit;

a restricting unit configured to restrict transfer of a driving force from the first driving unit to the first conveyance unit while the reversal unit is conveying a sheet in the first direction, and permit transfer of a driving force from the first driving unit to the first conveyance unit while the reversal unit is conveying a sheet in the second direction;

a second conveyance unit provided in the duplex conveyance path and on a downstream side of the first conveyance unit in the conveyance direction of the sheet, and configured to convey the sheet;

a third conveyance unit provided in the duplex conveyance path and on a downstream side of the second conveyance unit in the conveyance direction of the sheet, and configured to convey the sheet;

a second driving unit configured to drive the second conveyance unit and the third conveyance unit;

a sheet detector provided between the second conveyance unit and the third conveyance unit in the duplex conveyance path, and configured to detect a sheet that has passed the second conveyance unit; and a controller configured to control the first driving unit and the second driving unit so as to drive both of the first driving unit and the second driving unit when resuming conveyance of a sheet conveyed on the duplex conveyance path after causing the sheet to wait at the second conveyance unit, wherein the controller controls the first driving unit such that a leading end portion of a first sheet stops at a first stop position, which is a position of the second conveyance unit, wherein the controller controls the second driving unit to resume conveyance of the first sheet stopped at the first stop position and controls the first driving unit such that the reversal unit conveys a second sheet succeeding the first sheet in the first direction to convey the second sheet to the reversing and conveying path, and wherein the controller stops the second driving unit in a case in which the sheet detector does not detect the first sheet within a predetermined elapsed time since the conveyance of the first sheet was resumed, and after a trailing end portion of the second sheet reaches a second stop position, which is on an upstream side of the reversal unit with respect to the first direction, controls the first driving unit and the second driving unit such that the reversal unit conveys the second sheet in the second direction and the second sheet is conveyed to the first stop position using the first driving unit and the second driving unit.

* * * * *